US005570887A

United States Patent [19]

Christie, Jr.

[11] Patent Number: 5,570,887

[45] Date of Patent: Nov. 5, 1996

[54] APPARATUS AND METHOD OF PLAYING A MEDIEVAL MILITARY CONFLICT BOARD GAME FOR TWO TO FOUR PLAYERS

[76] Inventor: George Christie, Jr., 79 Griswold Dr., Griswold, Conn. 06351

[21] Appl. No.: 446,477

[22] Filed: May 22, 1995

[51] Int. Cl.[6] ..... A63F 3/02

[52] U.S. Cl. ..... 273/261; 273/ 262

[58] Field of Search ..... 273/261, 262, 273/260

[56] References Cited

U.S. PATENT DOCUMENTS

| | | | |
|---|---|---|---|
| 1,679,652 | 8/1928 | Dalrymple | 273/261 |
| 3,610,626 | 10/1971 | Nolte | 273/261 |
| 4,244,579 | 1/1981 | Campos | 273/243 |
| 4,373,731 | 2/1983 | Whiteman et al. | 273/262 |
| 4,415,160 | 11/1983 | Lamb | 273/243 |
| 4,687,206 | 8/1987 | Cordry et al. | 273/262 |
| 4,927,157 | 5/1990 | Riihiluoma et al. | 273/260 |
| 4,982,965 | 1/1991 | Dozorsky | 273/262 |
| 5,150,908 | 9/1992 | Codinha | 273/262 |

FOREIGN PATENT DOCUMENTS

| | | | |
|---|---|---|---|
| 886460 | 10/1943 | France . | |
| 2002640 | 2/1979 | United Kingdom . | |
| 2070446 | 9/1981 | United Kingdom | 273/260 |

OTHER PUBLICATIONS

"Shahmot" Britton Enterprises, advertizement in Games Magazine, Dec., 1993, vol. 17 No. 6, p. 71.

"Superchess", Green Island Games Co., 1993.

*Primary Examiner*—Benjamin H. Layno

*Attorney, Agent, or Firm*—Richard C. Litman

[57] ABSTRACT

A board game for two to four players provides a simulation of conflict between opposing monarchies in a medieval European culture. Players each control several different types of playing pieces, with the pieces each having different movement patterns on the board. Chance elements are also provided by the random drawing of cards and casting of dice, with the dice having different numbers of faces arranged in regular polyhedral configurations. Plural pieces may be moved by a player in a single turn, according to the total number of spaces determined by the casting of the appropriate die. Playing pieces may have differing levels of strength, and those levels may vary during the course of the game. Conflict between two opposing pieces may involve multiple turns by the two opposing players, depending upon the pieces and their respective strengths. Trades of various articles may also be made between allied pieces controlled by any one given player. The object of the game is to conquer the opposing players'kingdom(s), by capturing or defeating their playing pieces and king(s).

20 Claims, 10 Drawing Sheets

APPARATUS AND METHOD OF PLAYING A MEDIEVAL MILITARY CONFLICT BOARD GAME FOR TWO TO FOUR PLAYERS

FIELD OF THE INVENTION

The present invention relates generally to board games, and more specifically to a board game apparatus and method of play including playing pieces having different patterns of movement and levels of strength. The game also includes elements of chance determined by the casting of dice having different numbers of faces, and also by the drawing of cards containing instructions which affect the play of the game.

BACKGROUND OF THE INVENTION

Many persons enjoy playing games of various sorts during their leisure time; various relatively simple games have been known virtually since the beginnings of civilization. With the advance of time, however, many game players have devised more complex games and rules of play for existing games, to add further mental challenge to the play.

Another frequently recurring theme with games is the simulation of a particular period or culture, either historical or mythical, or perhaps some combination of the two. A relatively simple example of the above is the game of chess, which simulates opposing monarchies in conflict. More recently, the theme of conflict has been used in board games of various types in which more modern warfare has been simulated. Earlier historical periods have been used as background for various role playing games, but little has been done to expand upon the general concept of the game of chess, adding chance means, prolonged battles, and other features, in a simulated medieval European culture.

Accordingly, a need will be seen for a board game apparatus and method of play, which includes playing pieces having different patterns of movement, as in the game of chess, but which includes further features, such as chance means provided by dice of different configurations and cards having different instructions thereon. The game should loosely simulate the medieval European period, having allusions to royalty, feudal society, and the social hierarchy thereof, as well as mythological creatures and powers. In addition to the different movement patterns provided by the different playing pieces, different levels of strength and prolonged battles between playing pieces should be provided, adding further challenge to the game. The combination of skill required for expert play of the game, in addition to the chance elements provided, enable players of lesser skill levels to have some chance of success in the game against more expert players.

DESCRIPTION OF THE PRIOR ART

U. S. Pat. No. 1,679,652 issued to James M. Dalrymple on Aug. 7, 1928 describes a Checker Game Board having a generally octagonal configuration and using checker playing pieces. The game also uses conventional playing cards comprising the conventional four suits, for play. While slight variations in moves are permitted, akin to those permitted in checkers, no significant move variations (i.e., moves directly along ranks and files, etc.) are permitted, as in the present game. No disclosure of different levels of strength of the pieces, prolonged battles, use of the diagonal corners of the board, or of chance means comprising dice of different configurations, is disclosed by Dalrymple.

U.S. Pat. No. 4,244,579 issued to Luis B. Campos on Jan. 3, 1981 describes a Board Game utilizing a square board having a spiral path thereon for play. Game pieces are restricted to movement along the spiral path, unlike the present game. Movement of the game pieces is determined purely by chance means, and is dictated strictly by the toss of dice and/or the drawing of cards. Capture of opponents playing pieces is permitted, as in the present game, but the opportunity for capture is determined solely by chance, unlike the present game. While the point values awarded for capture are determined by the value of the captured and capturing pieces, no variation in strength of those pieces during play is provided by Campos, as is provided by the present game.

U.S. Pat. No. 4,373,731 issued to Dennis J. C. Whiteman et al. on Feb. 15, 1983 describes a Board Game having a rectangular game board with only two mirror image playing areas representing geographical areas, thereon. Different playing pieces having different movement patterns are provided, as well as chance means affecting the play of the game. The game board is considerably different than the present game board, and no disclosure is made of any means of altering the strength of any of the playing pieces, or prolonged battles between pieces, as provided in the present game.

U.S. Pat. No. 4,415,160 issued to Herbert J. Lamb on Nov. 15, 1983 describes a Game Apparatus in which only two playing pieces (one white knight and one black knight) are permitted to move for each of four players. Each of the player's two playing pieces are identical to one another. Most of the outcome of the game appears to be determined by chance, rather than player determination of piece movement, as in the present game.

U.S. Pat. No. 4,687,206 issued to Christopher D. Cordry et al. on Aug. 18, 1987 describes a Global Domination Board Game simulating modern nuclear warfare on an intercontinental scale. According to the rules of the Cordry et al. game, it is possible that no player wins the game, depending upon the degree of simulated destruction occurring during play. The game depends heavily upon random means determined by the drawing of cards, for the outcome of play. While the relative strength of opposing sides may vary, the strength of individual pieces remains constant. No prolonged battles between individual opposing pieces is disclosed, as provided by the present game. Also, Cordry et al. use a simulated period of elapsed time during the course of play of their game, unlike the present game.

U.S. Pat. No. 4,927,157 issued to Clayton Riihiluoma et al. on May 22, 1990 describes a Chess-Like Board Game Apparatus And Method Of Playing The Same, comprising a two level playing board with each board having fewer than the standard number of playing positions thereon. A reduced number of standard chess pieces, using standard chess movement patterns, is provided for each of two players. A cubical die is used to designate by chance, the specific playing piece to be moved (if any) at a given turn. The pieces retain their relative strength levels throughout the game, and no prolonged battles between individual playing pieces occur.

U.S. Pat. No. 4,982,965 issued to Wolodymyr Y. Dozorsky on Jan. 8, 1991 describes a Strategic Military Type Board Game similar to chess, with each of two players having control over a variety of pieces having various patterns of movement. No prolonged battles between pieces, provision for more than two players, nor chance means is disclosed by Dozorsky.

U.S. Pat. No. 5,150,908 issued to J. Albert Codinha on Sep. 29, 1992 describes a Military Conflict Board Game wherein the game board represents a schematic global map with a rectangular peripheral playing path. Two basically different types of playing pieces are used, with one type being restricted to movement about the peripheral path, and another type being restricted to placement on the central map area of the board. No disclosure is made of the playing pieces changing strength during the course of play, or of prolonged battles between two opposing pieces, as provided by the present game.

French Patent Publication No. 886,460 to Maurice Clauzier and published on Oct. 15, 1943 describes a game simulating phases of a naval battle or the like. The game board is slightly elliptical, and represents the Mediterranean Sea and immediately adjacent land areas. The Clauzier game provides for only two players, and no disclosure is made of any variation in the strength of individual playing pieces nor of prolonged battles between any two opposing playing pieces, as in the present game.

British Patent Publication No. 2,002,640 to Anthony M. Read and published on Feb. 28, 1979 describes a War Game Apparatus simulating trench warfare over a limited area. While the ranges of at least some playing pieces are not revealed to the opposing players until those pieces are put in play, there is no variation in the strength of the playing pieces during the course of play, as in the present game. No prolonged battles between individual opposing pieces nor chance means are disclosed by Read, as provided in the present game.

Finally, British Patent Publication No. 2,070,446 to Michael J. Taylor and published on Sep. 9, 1981 describes a War Board Game using some of the playing pieces (and their movement patterns) from the game of chess. Additional pieces are provided, simulating modern military weaponry. The basic game, however, is more closely related to chess than to the present game, and does not provide for chance means or prolonged battle between two opposing pieces, as provided in the present game.

None of the above noted patents, taken either singly or in combination, are seen to disclose the specific arrangement of concepts disclosed by the present invention.

SUMMARY OF THE INVENTION

By the present invention, an improved board game is disclosed.

Accordingly, one of the objects of the present invention is to provide an improved board game which reflects elements of medieval European culture and military conflict.

Another of the objects of the present invention is to provide an improved board game which includes a game board and other apparatus providing for two to four players.

Yet another of the objects of the present invention is to provide an improved board game which includes plural playing pieces for each player, which playing pieces have different patterns of movement and which may have different relative strengths at different time during the course of play of the game.

Still another of the objects of the present invention is to provide an improved board game which requires players to determine he movement of the various playing pieces in their control, but which also includes chance elements affecting the outcome.

A further object of the present invention is to provide an improved board game in which individual opposing playing pieces may become involved in prolonged battle, involving a plurality of turns by each player to resolve the outcome of the particular battle.

An additional object of the present invention is to provide an improved board game in which predetermined board positions are selected by each player for certain elements of play, and which predetermined positions are not disclosed to other players until they come into play.

Another object of the present invention is to provide an improved board game in which a player may move a plurality of that player's pieces during a single turn, in accordance with the total number of movement spaces randomly provided at that turn.

Yet another object of the present invention is to provide an improved board game in which a player may trade certain articles between allied playing pieces under the control of that player.

Still another object of the present invention is to provide an improved board game which chance elements comprise both randomly selected cards and randomly cast dice, with the dice comprising different regular polyhedral shapes and configurations.

A final object of the present invention is to provide an improved board game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 4B is a plan view of the front of an ancient relic card used in the play of the present game.

FIG. 4D is a plan view of the front of a guardian card used in the play of the present game.

Similar reference characters denote corresponding features consistently throughout the figures of the attached drawings.

DETAILED DESCRIPTION OF THE PREFERRED EMBODIMENT

I. Game Equipment

Figure 1:
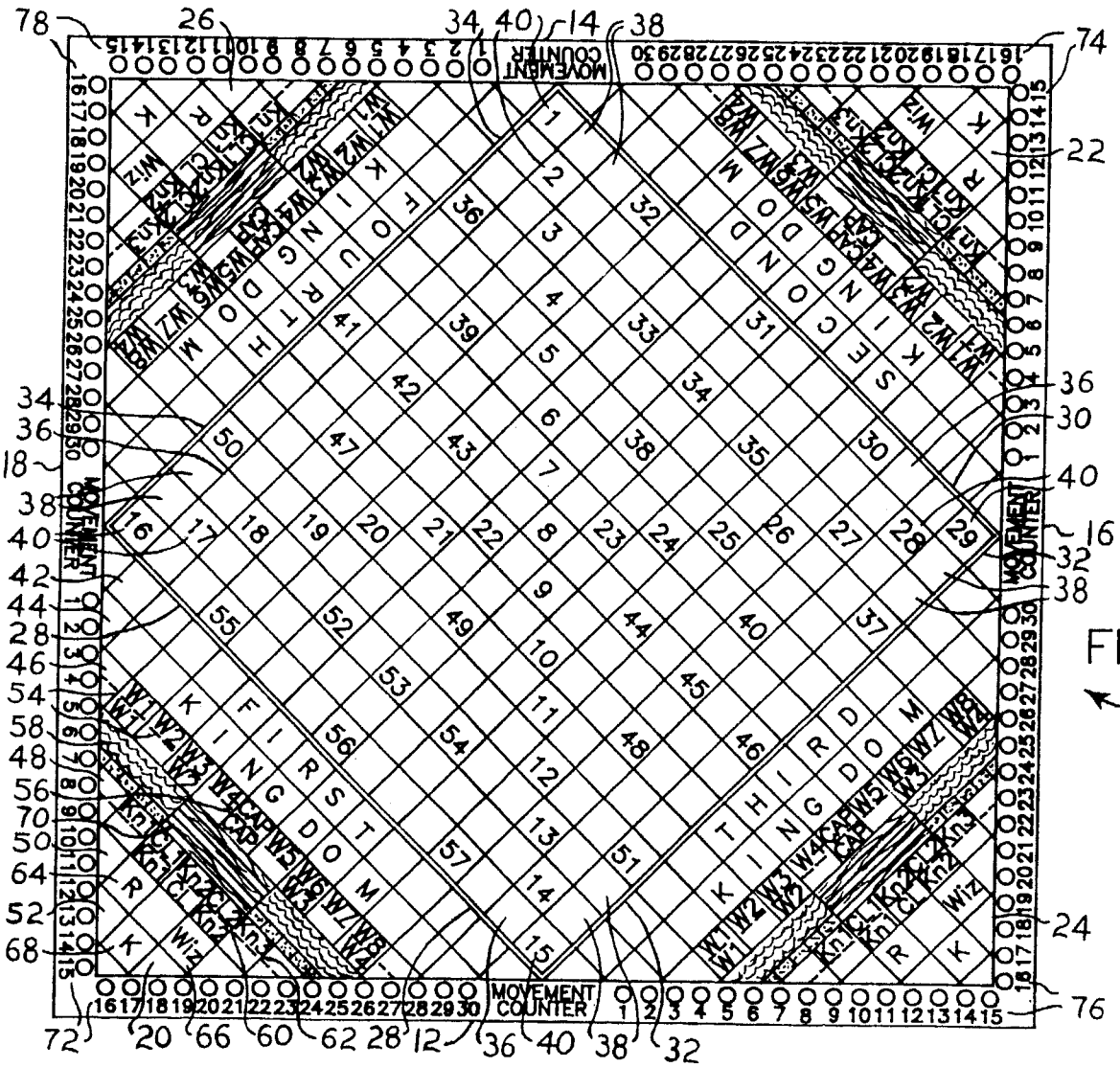
FIG. 1 is a top plan view of a game board used for play of the present board game, showing its various features.

Referring now to the drawings, the present invention will be seen to relate to a board game for a plurality of players and including elements of conflict in a medieval European cultural theme. FIG. 1 discloses a plan view of the game board 10 of the present game. The game board is a substantially square shape, with four sides 12 through 18 of equal length and four corners 20 through 26 at the juncture of each two sides. Each of the corners 20 through 26 (designated as "First Kingdom" through "Fourth Kingdom" in FIG. 1) encompasses a right triangular area with the respective hypotenuse 28 through 34 extending from the midpoints of the respective two adjacent sides, e.g., the hypotenuse boundary 28 of the first player corner 20 extends from the midpoint of the fourth side 18, diagonally across the board to the midpoint of the first side 12. Each corner 20 through 26 is controlled by one player of the game, and the set of playing pieces controlled by each player are placed in that player's corner area to start the game. (Alternatively, two players may face one another, with an alternative playing piece starting array.)

The remaining portion of the game board 10 thus comprises a substantially square central common playing area 36 defined by the hypotenuse 28 through 34 of each of the triangular player corners 20 through 26. This common playing field or area 36 is divided into a plurality of individual playing spaces or squares 38, with a fraction of those spaces 40 including numbers thereon, the purpose of which is explained further below. In the embodiment of FIG. 1, the individual playing spaces 38 and 40 comprise a matrix of fifteen by fifteen spaces, totaling 225 spaces. A total of fifty seven numbered spaces or positions 40 are provided, with the numbers disposed in a symmetrical array on the central playing field 36. The spaces 38 and 40 are in an orthogonal array relative to the hypotenuse individual player area borders 28 through 34, and thus are disposed diagonally relative to the board sides 12 through 18. Other configurations of spaces may be used as desired comprising either greater or lesser numbers of unnumbered and numbered spaces, and different ratios of numbered spaces to unnumbered spaces, as desired.

Each of the triangular individual player areas or corners 20 through 26 is of a like configuration, and provides a number of designated playing spaces for the starting array of playing pieces controlled by the respective player of that corner area. Accordingly, a discussion of the features of the player corner 20 comprising the "First Kingdom" area follows, with the understanding that this area is identically configured to the other three triangular individual player areas or corners 22 through 26 of the board 10.

A total of six complete diagonal rows of playing position spaces, designated as rows 42 through 52, are provided in each of the corner areas 20 through 26, with the first row 42 adjacent the hypotenuse border 28 of the first individual player area corner 20 and the last row 52 comprising a single complete space at the apex of the corner area 20. The rows 42 through 52 respectively contain thirteen, eleven, nine, five, three, and one full space(s) each. (The diagonal half spaces at the ends of each of the rows 42 through 52 are not used.)

The first two rows 42 and 44, closest to the hypotenuse border 28, are not used during initial setup, but may be used for play once the game has started. The third row 46 is used for setup of the starting array of the first row of playing pieces, comprising a plurality of "warrior" pieces 54 and a single "captain" piece 56. These "warrior" and "captain" pieces 54 and 56 are "outside the wall," designated by a "wall and gate" row 58, which is not used in play except to pass through a limited area thereof. No playing pieces are allowed to remain on the wall/gate row 58.

It will be noted that the third row 46, providing for the warrior and captain playing pieces 54 and 56 in their starting array, is divided laterally, with different designations of pieces un either side of the division. This is to provide for play of the game by two, three, or four players. In the case of three or four players, a lesser number of pieces is used to avoid congestion on the board 10 during play. In such case, the starting array of the lower portion of the row 46 is used, wherein a captain piece 56 is centered in the row with two warrior pieces 54 placed to each side thereof (W1 and W2 to one side, and W3 and W4 to the opposite side) with each piece 54/56 separated by an open space from one another.

Additional pieces are used for play by only two players, as designated by the alternative player piece starting array of the upper portion of the divided row 46. Here, four warrior pieces 54 (W1 through W4) are placed on the first four spaces of the nine space row 46, and another four warrior pieces (W5 through W8) are placed on the last four spaces of the row 46. The center space is used for the captain piece 56.

The next usable row of player positions or spaces, row 48, is "behind the castle wall" from the first three rows 42 through 46, and playing pieces thereon (and on the remaining rows 50 and 52) are "in the castle" to start play. As in the case of the warrior and captain row 46 discussed above, the five space "cleric" and "knight" row 48 provides for alternative quantities and positioning of playing pieces, depending upon whether two, three, or four players are playing the game. In the case of three or four players, where fewer pieces are used, a single "cleric" piece 60 is initially placed in the center of the row 48, with one "knight" piece 62 to either side thereof (Kn1 and Kn2). When only two players are involved, additional pieces may be used, hence the provision on the second half of the divided row 48 for three knight pieces 62 (Kn1, Kn2, and Kn3) to be placed upon the five space row 48 with a space between each, and two cleric pieces 60 to be placed un the spaces remaining between the three knight pieces 62.

The fifth row 50 contains only three playing positions, with the leftmost used as the starting point for a "rogue" piece 64, and the rightmost as the starting point for a "wizard" piece 66. These same two pieces 64/66 are used in the same starting array by two, three, or four players. Finally, a king playing piece 68 is initially placed on the single place of row 52.

As noted above, one row 58 serves as a limited barrier across the individual player area. This row 58 designates a "castle wall" and "moat" area nominally seven playing spaces in length, having a central "gate" or "drawbridge" area 70 which is three positions wide. All playing pieces must enter and exit the "castle" area comprising the final three rows 48 through 52, by this three position wide "gate" area 70; movement of pieces directly across or over the wall portion of the barrier row 58 is not allowed.

Finally, the board 10 includes four elongate movement counters 72 through 78 disposed about the periphery of the board 10. Each of the movement counters extends from one end to the opposite end of the respective hypotenuse which separates the corresponding individual player corner area from the common central playing area 36 of the board 10, and around the outer corner of that individual player area. Thus, in the case of the "First Kingdom" corner 20, the movement counter 72 begins with a first position adjacent the midpoint of the fourth side 18, and continues around the outer side of the corner 20 to a thirtieth position adjacent the midpoint of the first side 12. Thus, each movement counter defines two of the three sides of the respective triangular individual player area, with the respective hypotenuse of that area defining the third side. These movement counters 72 through 78 provide a means for each player to keep track of the number of positions moved by his/her player piece(s) during a turn. The present game allows a player to move more than one piece and a total movement by all pieces during that turn of up to thirty positions. Hence, a player may move one piece ten positions, whereupon a marker is used along that player's peripheral movement counter to remind the player of the number of allotted positions already used on that turn.

As noted above, each player controls a plurality of playing pieces having different designations, patterns of movement, and other characteristics. FIGS. 3A through 3D provide schematic representations of the movement patterns of these various pieces across the common central playing area 36 of the game board. (It will be noted that the various pieces are represented symbolically, with the actual appearance of each piece not disclosed. The present game lends itself to play using pieces having virtually any appearance, with the movement patterns and other characteristics provided by the rules of the present game being critical.)

Figure 3A:
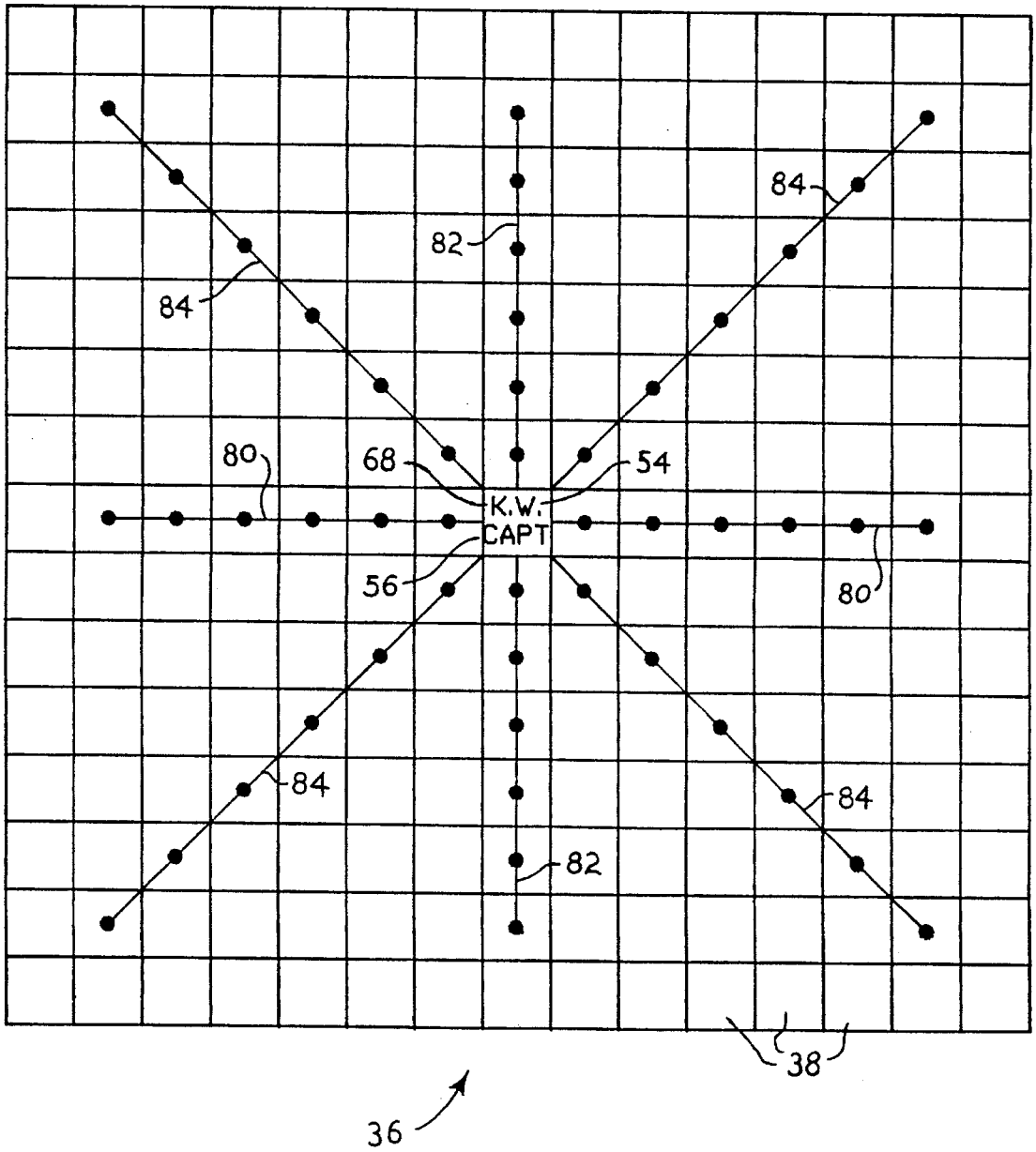
FIG. 3A is a schematic diagram of the permissible movement pattern of the king, warrior, and captain playing pieces of the present game.

FIG. 3A discloses the movement pattern of the king, captain, and warrior playing pieces 68, 56, and 54 across the central portion 36 of the game board. (The same movement pattern is permitted within the individual player areas or corners 20 through 26, being limited only by the peripheries of the field of playing spaces 38 and the barrier row 58 within each of the areas 20 through 26.) Each of these pieces 54, 56, and 68 may move up to six spaces in any direction along a rank 80, file 82, or diagonal 84 row of spaces 38, as desired and in accordance with the other limits of the board 10 and rules. (It will be noted that the terms "rank, " "file," and "diagonal" are in reference to the rectilinear borders of the central playing area 36 shown in FIGS. 3A through 3D, and not in reference to the sides 12 through 18 of the board 10, as the central playing field 36 is diagonally disposed on the board 10.) Once any of the above warrior, captain, or king pieces 54/56/68 begins a move in one of the permitted directions, no change of course is permitted, i.e., if the piece begins to move diagonally, the final position for that move must be along the same diagonal line.

Figure 3B:
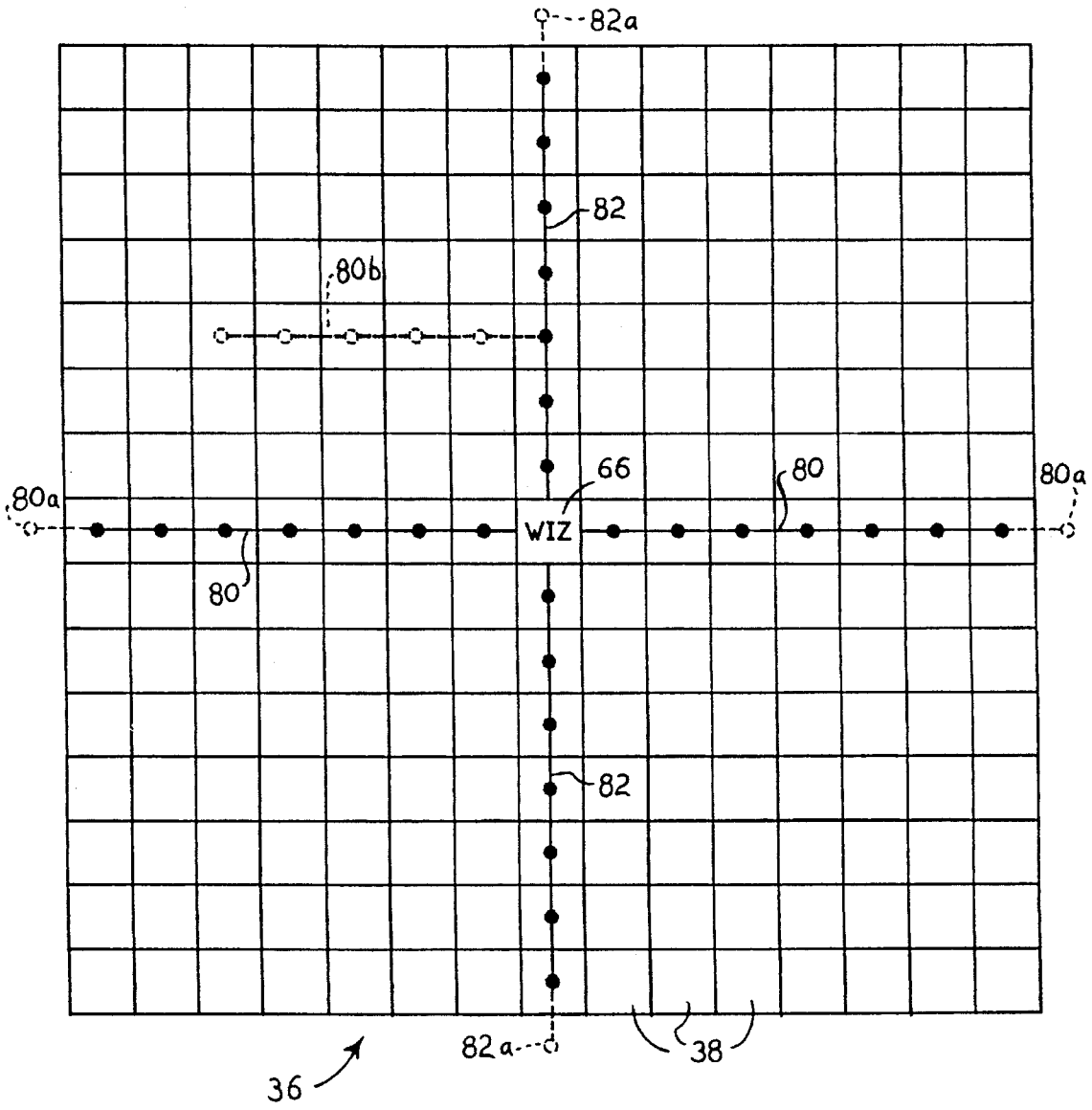
FIG. 3B is s schematic diagram of the permissible movement pattern of a wizard playing piece of the present game.

FIG. 3B discloses the movement pattern for a wizard piece 66. The wizard piece 66 may move up to eight spaces along any rank 80 or file 82, but cannot move diagonally. (The central area 36 of the board comprises a matrix of fifteen by fifteen spaces 38, as noted above. Thus, a wizard piece 66 starting from the center space of the central area 36, as in FIG. 3B, could move from the central area 36 and into the first row of any of the individual player corner areas 20 through 26, which areas are omitted from FIGS. 3A through 3C for clarity. Such maximally extended final positions **80*a* and 82*a* are shown in broken lines in FIG. 3B**.)

However, wizard pieces 66 are permitted an additional degree of movement over that permitted for the warrior, captain and king pieces 54/56/68 discussed above, in that wizard pieces 66 are permitted to change direction once (and only once) on any move. Thus, in the example of FIG. 3B, a wizard piece 66 may start from the center position on the board, as shown, move three spaces upward along a file 82, and then change direction and move a maximum of another five spaces along a rank **80*b* (shown in broken lines and circles as an alternative of the continuous upward file movement in solid lines and dots) to achieve the maximum permissible eight spaces or positions of movement for a wizard piece 66. Numerous other variations on the above pattern are permissible, e. g., seven spaces along a rank or file, with a 90 degree turn for the last space; movement over a lesser number of spaces, with a 90 degree turn, totaling from two to eight total spaces moved; or movement along a rank or file of from one to eight spaces, with no change of direction. It will be seen that, given the change of direction option, a wizard piece 66 may cover a substantial portion of the board 10** in a single move.

Figure 3C:
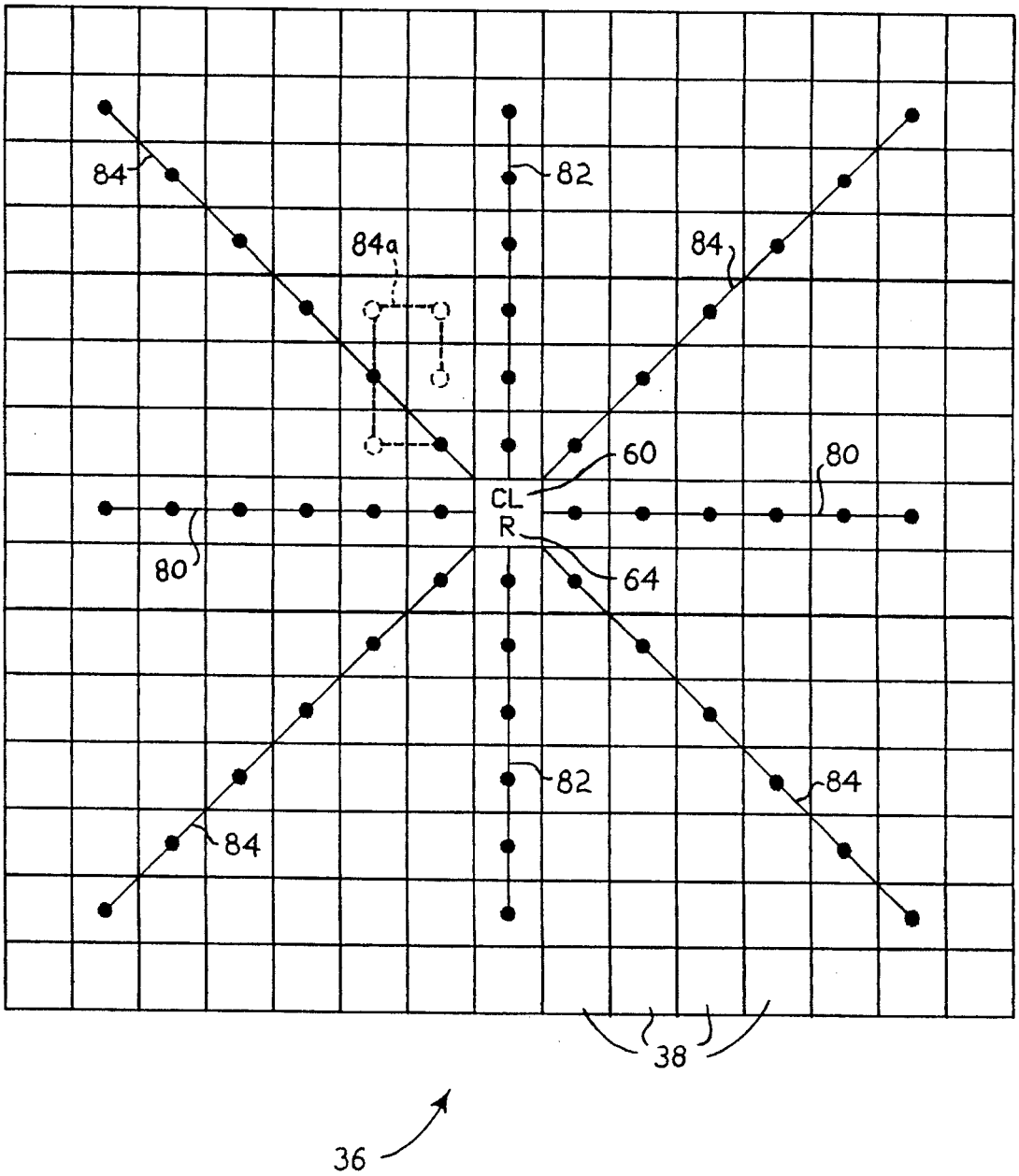
FIG. 3C is a schematic diagram of the permissible movement pattern of the cleric and rogue playing pieces of the present game.

FIG. 3C discloses the movement patterns for cleric and rogue pieces 60 and 64. The cleric/rogue patterns are quite versatile, with each piece 60/64 being permitted to move a maximum of six positions horizontally, vertically, or diagonally, as shown by the ranks 80, files 82, and diagonals 84 extending from the starting position of the area 36 of FIG. 3C. In addition, the cleric and rogue pieces 60/64 may change direction as many times as desired. An example is shown by the broken line path **84*a*, wherein the piece 60/64 has moved one space diagonally, turned left to move one space laterally along a rank, turned again to the right to move three spaces vertically along a file, and turned twice more to the right, to move one space to the right along a rank and one more space downward along a file. Again, none of the playing pieces are required to use the maximum allotment of movement spaces or turns, but may move a fewer number of spaces and make a lesser number (or no) turns, as desired. However, the above described example shown by the path 84*a* may be advantageous to a cleric or rogue piece 60/64** in a congested area of the board, as jumping other pieces (whether an opponent's or one's own) is not permitted, and such a movement path may enable a piece to circumnavigate other pieces.

Figure 3D:
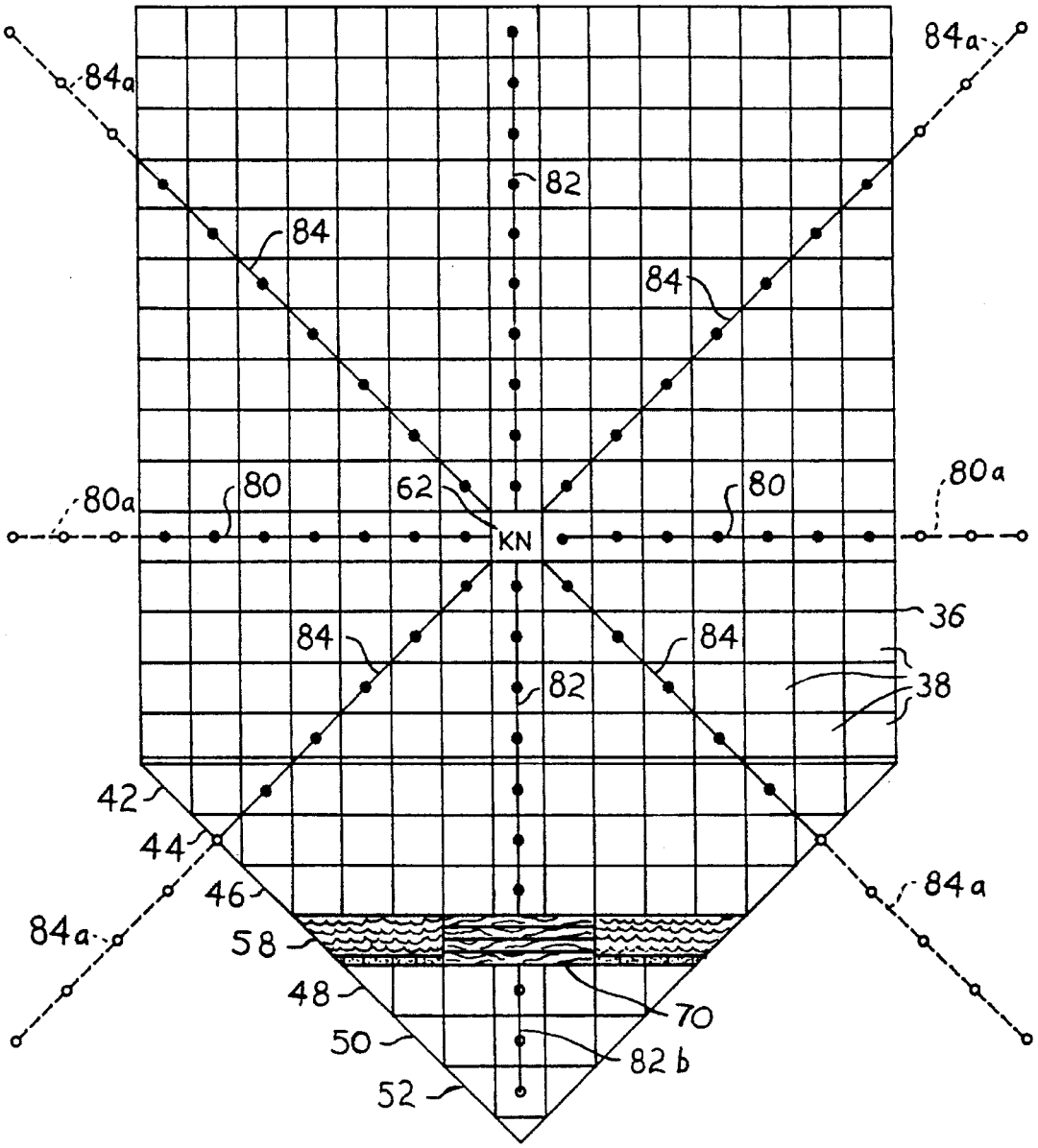
FIG. 3D is s schematic diagram of the permissible movement pattern of a knight playing piece of the present game.

The final playing piece movement pattern to be discussed is that of the knight 62, as shown in FIG. 3D. Knights 62 may move up to ten spaces along ranks 80, files 82, or diagonals 84. (It will be seen that in most situations, the maximum number of positions will be unavailable due to the edges of the board being reached before the maximum limit is reached, as indicated by the broken line diagonal positions **84*a*. Other broken line rank positions 80*a* represent travel into individual "kingdoms," not shown in FIG. 3D**, off the common center area.)

However, there is an additional restriction on the knight pieces 62, in that they are not permitted to proceed from the first three rows 42/44/46 of an individual player's area or "kingdom," across the "gate" area 70 of that area, and into the "castle" area comprising the final three rows 48/50/52 of an opponent's individual player area, in a single turn. Rather, the player must stop his/her knight 62 at the opponent's gate threshold row 46, and await his/her next turn to proceed across the "gate" or "drawbridge" 70, and into the "castle" rows 48/50/52 of the opponent. This is shown by the portion of the knight movement path 82 shown with open circles in the appropriate spaces in the "castle" rows 48/50/52 and designated as path 82*b*, in FIG. 3D.

Figure 2A:
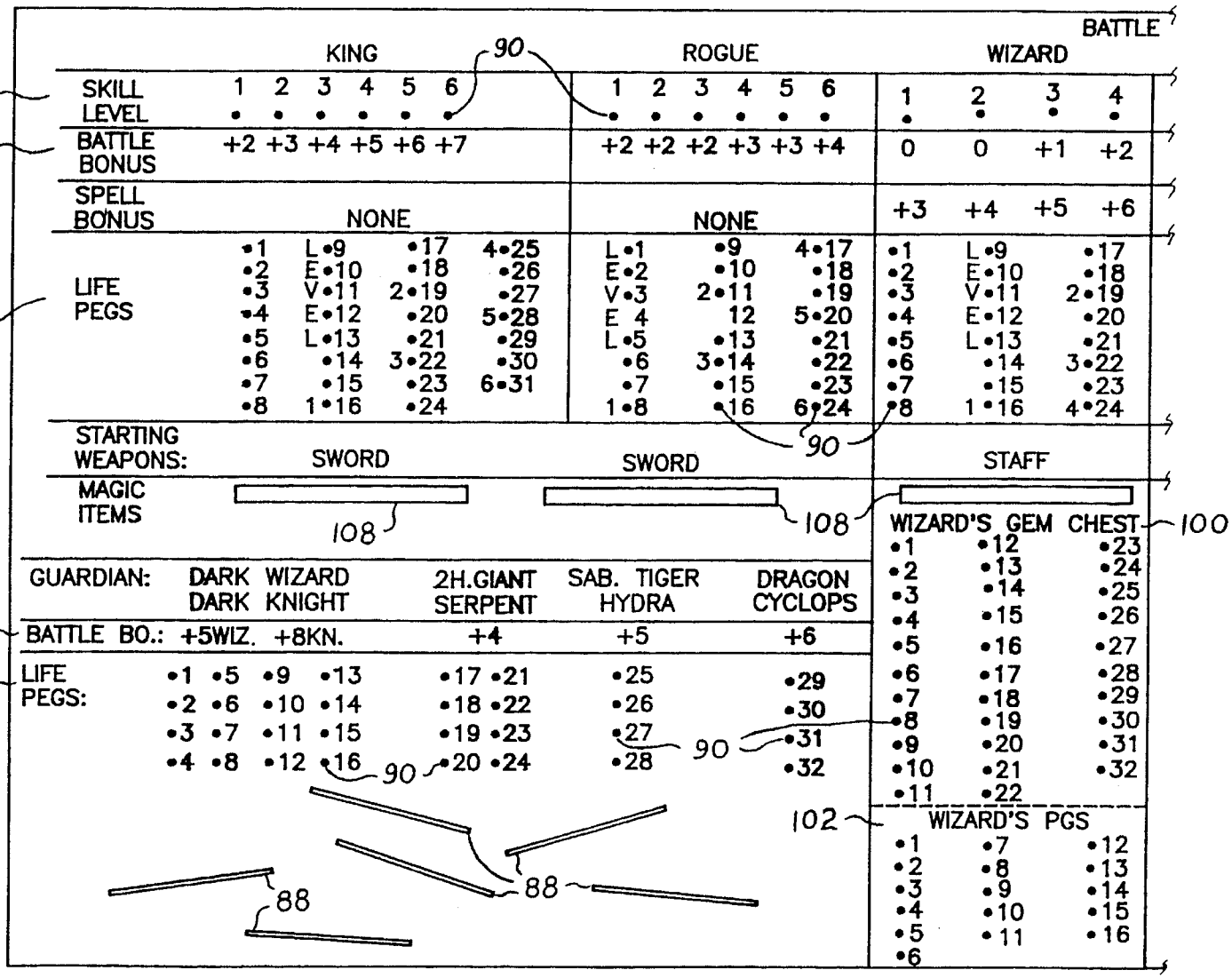
FIG. 2A is the left half of a game status board which is provided for each player, and showing its features.
Figure 2B:
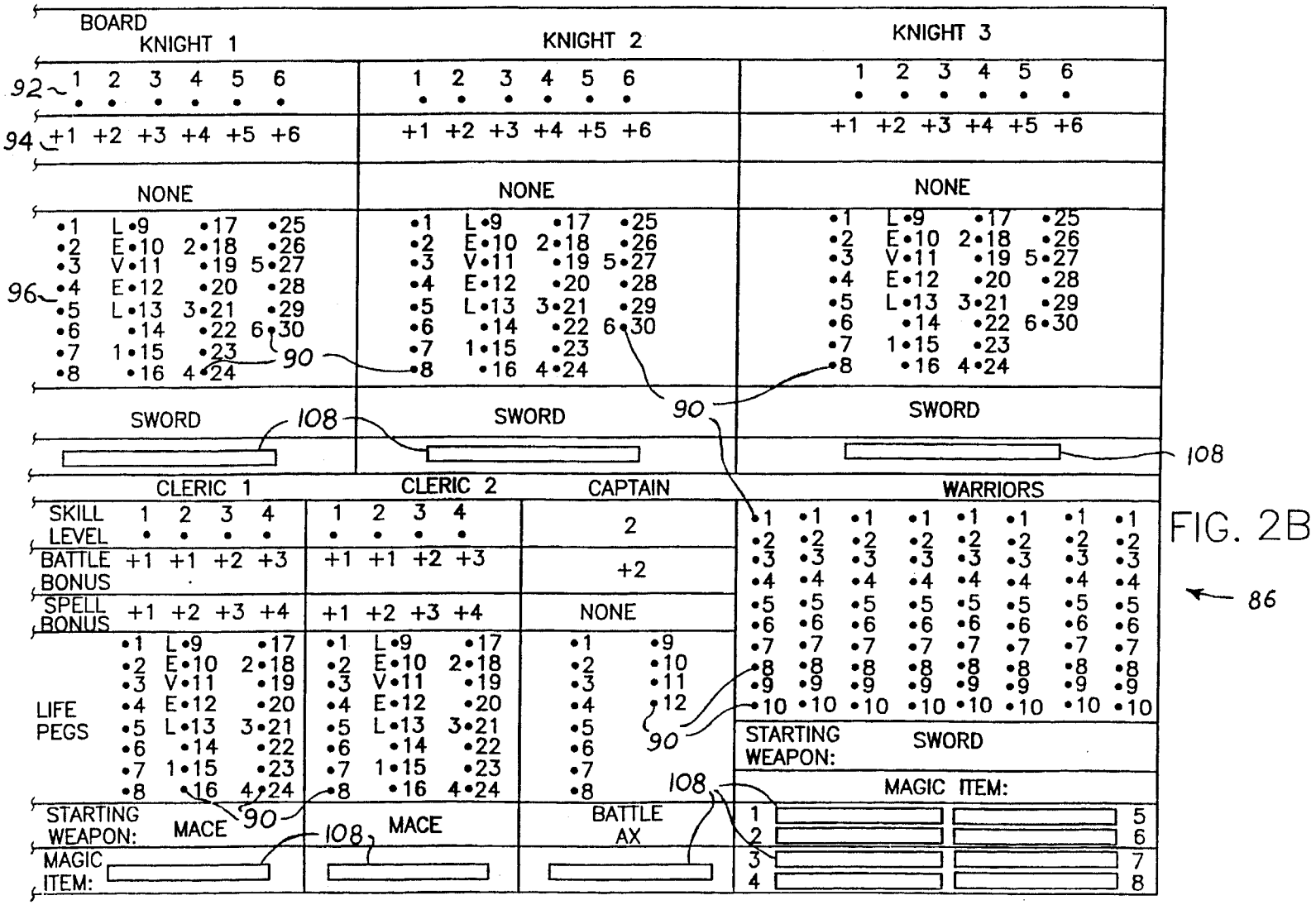
FIG. 2B is the right half of the status board of FIG. 2A.

In addition to the above described movement patterns for the various playing pieces, all of the various pieces are provided with randomly selected variable strength levels, and most are also provided with randomly selected variable skill levels, which levels are selected by chance means at the beginning of the game. These levels, as well as other attributes of the playing pieces, are variable during the course of play. The game status-board or "battle board" 86 of FIGS. 2A and 2B provides a means of keeping track of these variable levels for each piece for each player of the present game. Each of the players of the present game is provided with his or her own status board 86, whereby he/she may maintain a record of the current status of these variables for each piece during the course of play, by means of the pegs 88 provided. The pegs 88 are inserted into the appropriate peg holes, represented by the solid dots 90 in the various areas of the status board 86, during play to maintain the playing piece status record and other factors relating to the present game.

The upper row of the status board 86 of FIGS. 2A and 2B provides for the recording of the status of the king, rogue, wizard, and three knights (if only two are playing; only two knights are used for a three or four player game). The lower right portion of the board 86 (FIG. 2B) provides for the recording of the status of the two clerics (or one, if three or four persons are playing), the captain, and the four or eight warriors used in the game. A skill level row 92 is provided for each piece except the warrior pieces 54, with the skill levels of the king, rogue, and knights being randomly set from one to six and those of the wizard and clerics being randomly set from one to four at the beginning of the game. The captain skill level is permanently set at two, while the warriors are not provided with any particular skill level. The function of these skill levels is explained further below.

Immediately below the skill level row 92, a "battle bonus" table 94 is provided. Pieces involved in battle are provided with a bonus to be added to the random number generated to determine the battle outcome during play, which procedure is explained further below. The battle bonus is not directly variable or selectable by the players, but corresponds directly to the given skill level randomly determined for each given piece. Thus, a king having a skill level of five, would receive a bonus of six added to whatever count the player randomly cast during a "battle" phase of the game involving the king. A knight having a skill level of three, would receive a battle bonus of three added to the randomly determined count during a battle phase involving that knight. Other battle bonuses are determined in a similar manner. The captain receives a fixed battle bonus of two, while the warriors receive no battle bonus at any time. Other values may be set as desired.

Another variable provided for each of the playing pieces is the "life level" 96, which determines the strength of each of the playing pieces during battle. These strength or life levels are initially set according to the randomly determined skill levels set at the beginning of the game. In accordance with the exemplary skill levels described above for the king and knight, a king having a randomly determined skill level of five would initially have a peg 88 placed in the life peg field 96 at position twenty eight, which position is numbered immediately to the right of the corresponding peg hole and which corresponds to the five level number immediately to the left of that peg hole. A knight initially receiving a skill level of three, would have a peg 88 placed opposite the "three" number immediately to the left of the appropriate peg hole, which will be seen to correspond to a life or strength level of twenty one for that knight. These "life levels" or strength levels will vary when the piece is in battle with an opposing piece. The above values are exemplary of the present embodiment; other values may be provided as desired.

The wizard/cleric pieces 66/60 each have another attribute, wherein they may cast "spells" to attempt to gain advantage in play. The status board 86 includes "spell bonus" tables 98 ranging from three through six for the wizards 66 and from one through four for the clerics 60. The level of strength provided for such "spell casting" is determined when the skill level is randomly determined, with the spell bonus level being set at the corresponding position immediately below the skill level/battle bonus set for that piece. Thus, a wizard having a skill level of two, would automatically be given a battle bonus of zero and a spell bonus of four. "Spell casting" by cleric/wizard pieces is explained further below.

immediately below the skill level, battle bonus, spell bonus, and life status level of the wizard position on the status board, is a "gem chest" position 100 and a "Wizard's Power Gems" position 102. When any of the wizard pieces 66 optionally "cast a spell" during the course of play, they must use a given number of simulated "power gems," as explained further below. The "gem chest" 100 and "power gem" 102 areas of the status board 86 provide a means for each player to keep track of the number of such "power gems" used from whichever source, during the course of play. No actual articles representing "power gems" are exchanged during play, but tables or other means are provided which list the number of "power gems" used in any given transaction. The appropriate peg 88 is repositioned accordingly in the "gem chest" and/or "Wizard's Power Gems" area(s) 100/102.

Each player also controls a "guardian," which is provided with a predetermined battle bonus and corresponding "life peg" strength level, which level is recorded in the guardian life peg area 104 immediately below the corresponding guardian's battle bonus 106. For example, a player may randomly draw a card assigning him/her a "hydra" guardian. According to the battle bonus table immediately below the names of the various guardians on the status board 86, a "hydra" or a "sabertooth tiger" guardian is automatically given a battle bonus of five, and starts with the maximum number of "life peg" or status level points in the group immediately below that guardian, e.g., twenty eight, under the plus five battle bonus number. A player drawing a "dark wizard" or "dark knight" guardian card would have a battle bonus of five for the wizard (which also has a "spell bonus" of five) or eight for the knight, and would start "battle" with a "life peg" level of sixteen.

The status board 86 also includes a plurality of slots 108, providing for the insertion of the edge of a "magic item" card 110 therein. The magic card slots 108 provide for the information on the face of such a card 110 to be continuously visible only to the player corresponding to that particular board 86, while other players may only see the back of the magic card 110. These magic cards 110 are explained further below, in a discussion of the play of the game.

Figure 6:
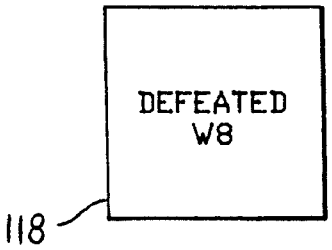
FIG. 6 is a plan view of a position marker used to mark the last board position of a defeated playing piece removed from the game board.

Three different decks of cards are provided with the present game, as described further below. During the setup of the game and before the start of play, each player of a three o four player game is randomly dealt three magic item cards 110 (or four such cards 110 for a two player game), and randomly draws one guardian card 112, one ancient relic card 114, and three lair cards 116. Examples of the backs of these cards 110 through 116 are shown in FIGS. 4A through 4D. In addition to the above magic item, guardian, ancient relic, and lair cards 110/112/14/116, each player is also provided with a plurality of defeated playing piece markers 118, an example of which is disclosed in FIG. 6. One marker 118 is provided for each playing piece, and generally conforms to the size and shape of one position or space 38/40 on the board 10.

A total of fifty seven lair cards 116, numbered consecutively from one through fifty seven and corresponding to the numbered positions 40 on the common central playing area 36, are provided with the game. The random selection of three of these cards 116 by each player determines the position of that player's guardian during initial play, with the other two positions being reserved as backups in the event a battle with that player's guardian occurs.

Each playing piece used in the present game also has a defeated playing piece marker 118 for that specific piece. Thus, a set of game pieces designated as K (King), R (Rogue), Wiz (Wizard), Kn1, Kn2, Kn3 (Knights one through three, for a two player game with the third knight in play), C11, C12 (Clerics one and two, with the second cleric in play for a two player game), Cap (Captain), and W1 through W8 (Warrior number one through Warrior number eight, for a two player game, with only Warriors number one through four being used for a three or four player game) have a like marked set of defeated player piece markers 118. An example of such a marker is the W8 (Warrior number eight) marker 118 of FIG. 6. These markers 118 are used to mark the last position of a playing piece defeated during the course of play. This is important in the present game, as specific defeated pieces may include various attributes, and/or may be revived during play. Thus, it is important to mark their last position(s) on the board 10. This procedure is explained more thoroughly in the discussion of the play of the game following further below.

Figure 4A:
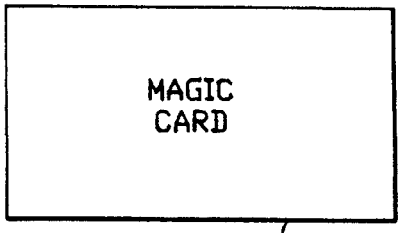
FIG. 4A is a plan view of the front of a magic card used in the play of the present game.
Figure 4C:
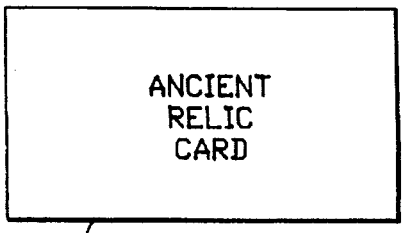
FIG. 4C is a plan view of the front of a lair card used in the play of the present game.
Figure 4C:
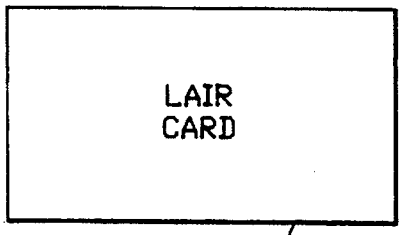

The magic item, guardian, and ancient relic cards 110, 112, and 114 respectively of FIGS. 4A, 4D, and 4B each include some form of instruction, assistance, penalty, or other factor affecting play, on the faces thereof. The three tables immediately following, provide a disclosure of the various instructions and factors on each of these cards 110, 112, and 114. It will be understood that the instructions and other factors listed in the following tables are exemplary, and that additional cards, having additional instructions, assistance, penalties, and/or other factors, may be provided as a part of the present game, if desired.

TABLE I. MAGIC ITEM CARDS

SWORD (long): Battle bonus of piece changes to +3. Clerics and Wizards cannot use this item.

SWORD (strong): Battle bonus of piece changes to +4. Clerics and Wizards cannot use this item.

SWORD (red): Battle bonus of piece changes to +5. Clerics and Wizards cannot use this item.

SWORD (crude): Add two to weapon's Life Peg damage. Clerics and Wizards cannot use this item.

SWORD (razor): Add four to weapon's Life Peg damage. Clerics and Wizards cannot use this item.

SWORD (broad): Battle bonus of piece changes to +5. Add one to weapon's Life Peg damage. Clerics and Wizards cannot use this item.

SWORD (double edge): Battle bonus of piece changes to +3. Add one to weapon's Life Peg damage. Clerics and Wizards cannot use this item.

MACE (breaker): Battle bonus of piece changes to +3. Wizards cannot use this item.

MACE (crusher): Battle bonus of piece changes to +3. Add two to weapon's Life Peg damage. Wizards cannot use this item.

BATTLE-AX (savage): Battle bonus of piece changes to +6. Add one to weapon's life peg damage. Only Warriors and Captains can use this item.

BATTLE-AX (savage II): Battle bonus of piece changes to +6. Add three to weapon's life peg damage. Only Warriors and Captains can use this item.

STAFF (striking): Battle bonus of piece changes to +5. Add three to weapon's life peg damage. Only Wizards and Clerics can use this item.

STAFF (damage): Add five to weapon's life peg damage. Only Wizards and Clerics can use this item.

SHIELD: Subtract one from weapon's life peg damage number, from hits on a piece with shield. This also applies to spells. Wizards cannot use this piece.

RING OF LIFE: Piece holding this card gains one life peg count per turn in which the piece does not move (not to exceed original life peg count for the piece).

BAG OF POWER GEMS: Contains ten Power Gems. Cannot be replenished during game. Only Wizards may use this item.

The guardian cards 112 provide specific information as to the relative "damage" which may be done to an opposing playing piece which attacks (or is attacked by) such a guardian. Each card 112 is specific to a particular guardian, and not only assigns that particular guardian to the player who randomly draws the card, but also provides that player with the information needed to use the guardian during the course of play. A table listing the attributes and characteristics of the guardian cards 112 is immediately below:

TABLE II

GUARDIAN CARDS

DARK KNIGHT: Begins game with sixteen life peg points and +8 battle bonus, per Battle Board.

DARK WIZARD: Begins game with sixteen life peg points and +3 battle bonus, per Battle Board. Dark Wizard also possesses a +5 spell bonus and an unlimited amount of power gems. The Dark Wizard vanishes with all his gems, when defeated.

SERPENT: Begins game with twenty four life peg points and +4 battle bonus, per Battle Board. Life peg damage to opponent (strength level) is determined by casting of battle die, as follows:

| Battle Roll Total | Life Peg Damage |
|---|---|
| 9–15 | 2 |
| 16–20 | 4 |
| 21–26 | 7 |
| 27+ | 9 |

TWO HEADED GIANT: Begins game with twenty four life peg points and +4 battle bonus, per Battle Board. Life peg damage to opponent (strength level) is determined by casting of battle die, as follows:

| Battle Roll Total | Life Peg Damage |
|---|---|
| 9–15 | 4 |
| 16–20 | 6 |

TABLE II-continued

GUARDIAN CARDS

| | |
|---|---|
| 21–26 | 10 |
| 27+ | 12 |

SABERTOOTH TIGER: Begins game with twenty eight life peg points and +5 battle bonus, per Battle Board. Life peg damage to opponent (strength level) is determined by casting of battle die, as follows:

| Battle Roll Total | Life Peg Damage |
|---|---|
| 9–15 | 4 |
| 16–20 | 6 |
| 21–26 | 10 |
| 27+ | 12 |

HYDRA: Begins game with twenty eight life peg points and +5 battle bonus, per Battle Board. Life peg damage to opponent (strength level) is determined by casting of battle die, as follows:

| Battle Roll Total | Life Peg Damage |
|---|---|
| 9–15 | 4 |
| 16–20 | 6 |
| 21–26 | 8 |
| 27+ | 10 |

DRAGON: Begins game with thirty two life peg points and +6 battle bonus, per Battle Board. Life peg damage to opponent (strength level) is determined by casting of battle die, as follows:

| Battle Roll Total | Life Peg Damage |
|---|---|
| 9–15 | 3 |
| 16–20 | 5 |
| 21–26 | 7 |
| 27+ | 9 |

CYCLOPS: Begins game with thirty two life peg points and +6 battle bonus, per Battle Board. Life peg damage to opponent (strength level) is determined by casting of battle die, as follows:

| Battle Roll Total | Life Peg Damage |
|---|---|
| 9–15 | 3 |
| 16–20 | 5 |
| 21–26 | 7 |
| 27+ | 9 |

The operation of the instructions contained in the above guardian cards is explained in the portion of the present disclosure relating to the rules of play of the present game, further below. As in the case of the magic cards of Table I, the above guardian cards are exemplary, and more or fewer cards, with different instructions and/or attributes, may be provided. No tangible token or other article is provided for the guardians, as their locations are not to be disclosed to other players unless an opposing piece terminates a move on a numbered position which happens to be the "lair" of a guardian. The guardians guard "ancient relics," which attributes are provided in a plurality of ancient relic cards 114; thus, as for the guardians, no tangible token is required for the ancient relics. Table III following provides a list of the ancient relics of the cards 114:

TABLE III. ANCIENT RELIC CARDS

RAZERBAC SWORD: Battle bonus of piece changes to +7. Add three to weapon's life peg damage. Clerics and Wizards cannot use this item.

HOLY SWORD: Battle bonus of piece changes to +8. Add three to weapon's life peg damage. Only Kings and Knights may use this item.

SAVAGE SWORD: Battle bonus of piece increases according to life peg damage lost in that battle. (e.g., piece holding Savage Sword loses five life points in a battle round, receives five battle bonus points for the next battle round, not to exceed a total of ten battle bonus points.) Battle bonus awarded during battle, drops to zero at end of any one battle. Clerics and Wizards cannot use this item.

SAVAGE MACE: Battle bonus of piece increases according to life peg damage lost in that battle. (e.g., piece holding Savage Mace loses five life points in a battle round, receives five battle'bonus points for the next battle round, not to exceed a total of ten battle bonus points.) Battle bonus awarded during battle, drops to zero at end of any one battle. Wizards cannot use this item.

DEFENDING MACE: Battle bonus of piece changes to +5. Subtract two from weapon's life peg point damage to opposing piece. Wizards cannot use this item.

STAFF OF POWER STRIKE: Increases battle bonus of piece by five points. If twenty six or more is cast using the battle die, subtract six more life points of damage from the opposing piece. Only Clerics and Wizards may use this item.

STAFF OF GEMS: Wizard holding this article may cast spells without expending power gems. However, if the count on the die cast for a spell exceeds twenty nine when using this relic, the staff will explode and cause eight life points of damage to the wielding Wizard. Only Wizards may use this item.

RING OF DISSPELL: The piece holding this relic is totally unaffected by any spell.

Figure 5A:
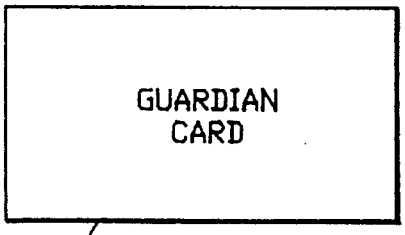
FIG. 5A is a view of a thirty faced regular polyhedral die used in the play of the present game.
Figure 5A:
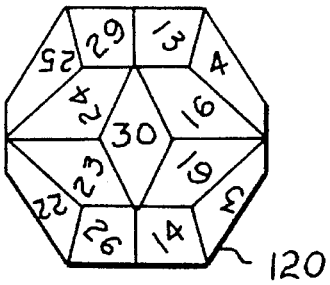

When pieces move or engage in battle, or when Cleric or Wizard pieces are used to "cast spells," a thirty sided die 120 (FIG. 5A) is used to determine the outcome, with one for each player. This die is a regular tetrahedron, having thirty rhomboid shaped faces. Only one side of the die 120 is shown in FIG. 5A. The procedure is explained in the rules of play, further below.

Figure 5B:
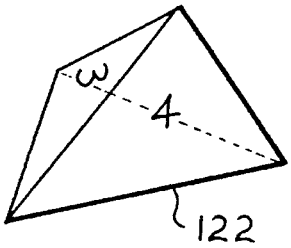
FIG. 5B is a perspective view of a tetrahedron die used in the play of the present game.
Figure 5C:
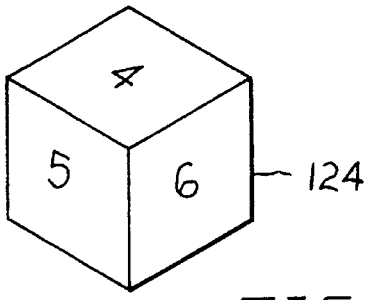
FIG. 5C is a perspective view of a cubic die used in the play of the present game.

Other dice used in the present game comprise a plurality of regular tetrahedral dice 122 (shown in perspective in FIG. 5B) and a plurality of conventional cubical dice 124 (shown in FIG. 5A). These dice are used to determine the skill levels, battle bonuses, spell bonuses, and strength level (as indicated in the "life peg" area of the status board for each player) for each of the playing pieces. Preferably, six cubical and four tetrahedral dice 124/122 are provided, to provide for the random selection of one of the six skill levels for the king, rogue, and three knights and the four skill levels for the wizard and two clerics used in the game as played by two players, with the lowest number of each set of cubical dice 124 and tetrahedral dice 122 being discarded during this phase of the game setup. A lesser number of the two types of dice 122/124 are used for three or four players, where only two knights and one cleric are used by each of the players.

II. RULES AND METHOD OF PLAY

The present game is played by two, three, or four players, using the game equipment discussed above. The game board 10 is set up, with each player positioning his/her playing pieces on his/her corresponding corner of the game board 10 according to the game piece layout of the third, fourth, fifth, and sixth individual player area rows 46, 48, 50, and 52 of the board 10. Two players will each control eight warrior pieces 54, three knight pieces 62, and two cleric pieces 60, while three or four players will each control four warrior pieces 54, two knight pieces 62, and a single cleric piece 60. Each player also controls a single king, rogue, wizard, and captain piece. The specific piece receiving any given randomly determined level is selected by each player as desired.

Levels are recorded on the status board 86, using the pegs 88.

Each player is also randomly provided with three (for three or four players) or four (for two players) of the magic item cards 110 which determine with which of the hypothetical items of Table I that player begins the game; three lair cards 116, which will correspond to three of the numbered positions 40 in the central playing area 36 of the board 10, and one of which that player will select as a first position for his/her "lair"; one guardian card 112, which determines the specific "guardian" of Table II which will be located at the selected lair position; and one ancient relic card 114, which determines the hypothetical relic of Table III which will be guarded by the guardian. The cards 110, 112, 114, and 116 issued to each player are concealed from other players, with the magic item cards 110 being inserted into the appropriate slots 108 of the status board 86, below the section of the board for the playing piece which will be controlling the "magic" of a given card 110. The above piece setup and card allocation is indicated generally as the first step 126, FIG. 7A.

Play proceeds with the player of the "first kingdom" corner 20 moving first, with the second, third, and fourth kingdom corner 22, 24, and 26 players following in that order. Each player in turn casts the thirty sided die 120, to determine the total number of positions he/she may move his/her playing pieces, as desired. The number is recorded on the appropriate peripheral movement counter 72/74/76/78 for that player. As an example, a player may cast a count of twenty three. This would allow any three of the warrior pieces 54 and/or the captain piece 56 in the third individual player row 46 immediately in front of the "castle wall" row 58, to move the maximum allowable six positions, with five positions remaining for one other piece.

It will be seen that pieces "behind the wall" cannot move forward until warrior and/or captain pieces 54/56 are moved. however, as the present game allows moves by more than a single piece in one turn, a player may wish to move the central captain piece 56, thus allowing movement by other pieces "behind the castle wall" to move across the "gate" 70, and onto or toward the central playing area 36. It should also be noted that a player is not required to use all of the move spaces or positions rolled or cast with the die 120. A player may use a smaller number of move positions, spread among one or more pieces, but may not take more than the maximum allotment. For example, a player nay reach the edge of the board (or the edge of the central playing area 36, which cannot be crossed into individual player areas not being used in the game) before using the otherwise maximum allowable number of moves of the playing piece, or as cast on the die 120. The peg or other recording device is moved in the peripheral movement counter 72/74/76/78 as each move is accomplished on the board 10, thereby allowing players to keep track of the remaining number of available movement positions or spaces.

The object of the present game is to "defeat" the king(s) of all other opponent(s) in the game. To do so, it will generally be necessary to "engage in battle" and "defeat" other playing pieces controlled by the opponent(s) in the game. "Battle engagement" is accomplished by deliberately moving a playing piece to the same specific playing position or space occupied by opposing playing piece, either within the central playing area 36 or within an individual playing area being controlled by one of the players of the present game. (Again, the two individual playing areas not in use when only two players are playing, are "off limits" for play.)

Unlike chess and many other games, the mere act of moving a playing piece to a position occupied by an opposing piece, does not automatically result in the defeat of the opposing piece and its removal from the board. In the present game, the pieces are deemed to be "engaged in battle," with the outcome determined by the casting of the thirty sided die 120 and other factors, as recorded on the status board 86 for each of the battling pieces. A player may engage in only one "battle" in a turn, no matter how man pieces he/she moves.

To determine the outcome of a battle, each of the two players whose pieces are engaged in the battle alternatingly cast the thirty sided die. The respective "battle bonuses" for the two engaged pieces are added to the respective number cast for each of he pieces, with the highest total winning that round of the battle. In all likelihood, this will not result in the defeat of either of the pieces, but only to a loss of "strength" or "life points" for the piece having the lower number during that round. Hence, it will be necessary to continue to cast the die 120, with the piece receiving the lower total for each round of the "battle" losing "life points" until being finally defeated (or retreating, as discussed further below). The loss of "life points" is shown on the "Weapon Damage Chart" of Table IV, immediately below:

TABLE IV

WEAPON DAMAGE CHART

| Winning Battle Roll Total: | 1–8 | 9–16 | 17–24 | 25+ |
|---|---|---|---|---|
| Weapon Type: | Life Points of Damage | | | |
| Staff | 1 | 1 | 2 | 3 |
| Mace | 1 | 1 | 3 | 5 |
| Sword | 1 | 2 | 3 | 4 |
| Battle Ax | 2 | 3 | 4 | 5 |

As an example of the use of the above table, a knight and a cleric from opposing sides may be engaged in battle. A knight may receive up to six "skill level" points to start the game, while a cleric may receive a maximum of four, in accordance with the values provided on the status board 86 for each player's pieces. Assuming the knight and cleric have been provided with the maximum possible skill levels (which depend upon the respective numbers:s cast using the six and four sided dice 124 and 122, as described above), they also receive a corresponding number of "life points," which might be considered to be analogous to a given level of strength.

In the case of the knight, a peg 88 would be placed in the hole of the "life peg" field between the number 6 (designating the skill level) and the number 30 (designating the corresponding life point or strength level). The "life level" of the cleric piece is determined in a similar manner. Assuming the cleric piece received the highest possible count using one of the tetrahedral dice 122, a peg 88 would be placed in the appropriate hole in the cleric "life point" field of the status board 86, between the number four (corresponding to the skill level determined by casting the tetrahedral die 122) and the corresponding life level of twenty four.

In each of the above examples, it will be seen that the maximum life level possible has been provided. It will be understood that lesser levels are more likely, depending upon the numbers resulting from the casting of the dice 122/124, arid the distribution and allocation of the numbers, and their corresponding skill levels and life or strength values or points, to the various pieces according to the desires of the players controlling those pieces.

Continuing the discussion of the above example, let us assume that the roll of the thirty sided die 120 results in a count of twenty five for the knight, and twenty seven for the cleric. This would appear initially to give the cleric piece the win in that round of battle. However, one must also take into account the "battle bonus" provided on the status board 86. The battle bonus points awarded to each piece and added to each count of the die, are found immediately below the skill level established for that piece. Thus, the knight with a skill level of six, will have a battle bonus of six points to be added to the twenty five points resulting from the casting of the die for this battle round. The cleric also has a maximum battle bonus, but that maximum value is only three points for the cleric, as opposed to six for the knight. Thus, the final score for each piece for this round of the battle is twenty five plus six= thirty one for the knight, and twenty seven plus three= thirty for the cleric. The knight would thus win this particular round of the battle.

When a piece loses a battle round as described above, "life points" are deducted from that piece in accordance with the "Weapon Damage" chart of Table III. A review of the battle board 86 shows that a knight begins the game with a sword as a weapon, while the cleric begins with a mace. A piece which is equipped with a sword, and which wins a round of battle with a score of thirty one (die plus battle bonus), will be seen to score the maximum number of damage points possible using the sword, i. e., four points. Thus, four "life points" are subtracted from the "life peg" field of the cleric engaged in battle, on the battle board for that player. The corresponding peg is moved accordingly from a "life peg" level of twenty four, to a level of twenty for the cleric for that round.

The battle continues according to the above rules, until one of the two pieces chooses to retreat or Until the "life peg" level of one of the two pieces of the battle is reduced to, one or less. When this occurs, that piece is "defeated," and is removed from the board. If the defeated piece also had a "magic" item as indicated on a "magic" card 110 provided to that piece at some point in the game, the victorious piece may appropriate the "magic" item of the defeated piece for its own use, if desired. The appropriated item must be compatible with the victorious piece, e. g, if the cleric had been victorious in the above example, he could not use a "magic" sword of a defeated knight. The corresponding marker 118 for that specific piece, is placed on the position from which the defeated piece is removed. These steps are indicate as 128, 130, and 132 in FIGS. 7A and 7B.

If a retreat is chosen, the retreating piece must have a winning "battle roll" of the thirty sided die 120, for that round. However, no "battle damage" is inflicted upon the opposing piece when a winning die cast is used for a retreat. Assuming such a numerically superior number is achieved, the player must roll the die 120 again to determine the number of spaces or positions over which the retreating piece may move (subject to the movement limitations of the specific piece and board limitations).

If a piece is moved to a numbered position which happens to be a "lair" position selected by an opponent, the piece may "battle" with the "guardian" of that lair in an attempt to defeat the guardian and capture the "relic" being guarded at that position. The battle procedure is as discussed above in the cleric and knight example, except that the statistics (i.e., "life peg" level and "battle bonus") of the guardian involved in the battle are used to determine the ultimate outcome, rather than another of the pieces controlled by that player. A guardian cannot retreat (or move, conventionally), but the other piece may retreat according to the above described rules. If the guardian is "defeated," the winning piece is considered to have captured the "relic" (described on the corresponding relic card 114 issued at the beginning of the game) and may use it in accordance with the appropriate rules of play; this is similar to the confiscation by a victorious piece of any "magic" item which had earlier been provided to a defeated piece, discussed further above.

When a battle with a guardian occurs, the lair position of that guardian is obviously known to all players at that point in the game. Accordingly, if the guardian is victorious, it is allowed to move to the second "lair" of that player. (Each player is provided with three numbered lair cards during the game setup, and may select the second lair position among those remaining.) If the second lair is exposed and the guardian is again victorious, it is moved to the third lair of that player, where it remains for the rest of the game, whether subsequently discovered again or not. It will be seen that the entire game may be played without a piece happening to come to rest upon a "lair" position. Thus, the engagement of a guardian in a battle, may or may not occur, and is indicated as an optional step 134 of FIG. 7A.

Figure 7A:
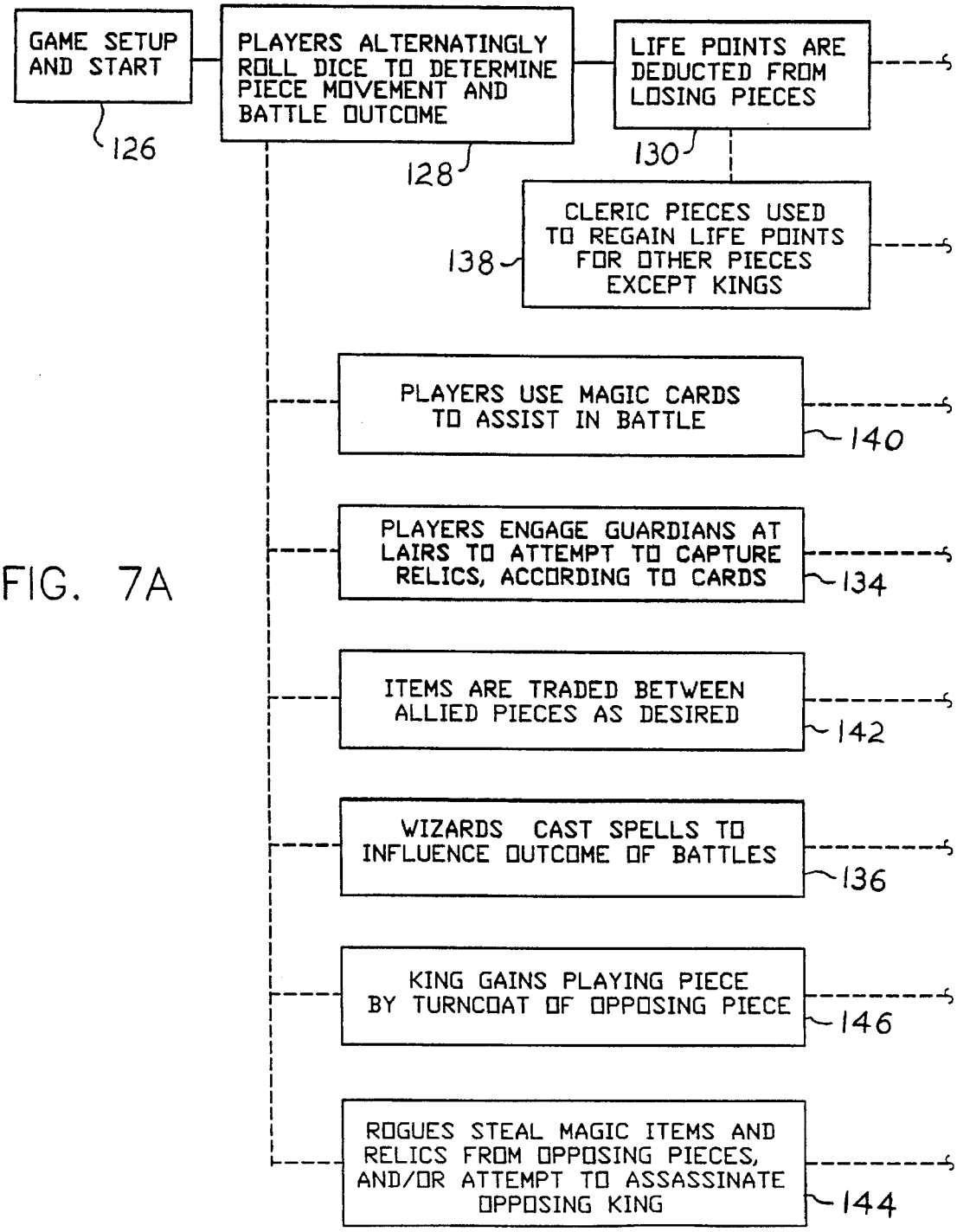
FIG. 7A is the left side of a flow chart showing the steps involved in the method of play of the present game.

While all pieces except the warriors may be provided with battle bonus points, only the wizards and clerics (and dark wizard guardian) are provided with spell casting bonus points. The spell bonus levels for these pieces is determined during the setup for the game, in accordance with the skill level determined for those pieces. Thus, a wizard being allotted a skill level of three, would automatically have a spell bonus of five, in accordance with the status board. The procedure is identical to that used to establish the battle bonus points. These optional steps 136 (wizards) and 138 (regaining by clerics) are shown in FIG. 7A.

A cleric or wizard piece may "cast a spell" to influence the outcome of a battle, as opposed to engaging in the battle directly. The procedure is identical to that described above, except that the "spell bonus" is added to the number cast with the thirty sided die 120, rather than the battle bonus. Cleric pieces have somewhat limited yet powerful capabilities, in that their "spells" are only used to "heal" or "regain" a defeated piece (i. e., one which has been removed from the board). In order for a piece to be "revived" by a cleric, (1) the cleric piece must be moved to a playing position immediately adjacent the marker of the defeated piece; (2) no earlier move by the cleric piece is permitted on that specific turn; and (3) no other playing piece of any side, may be resting upon the marker designating the piece to be regained.

The player must announce the type of spell, according to the following Spell Damage Chart:

TABLE V. SPELL DAMAGE CHART

Wizard Battle Spells

TELEPORT: Wizard may move through spaces occupied by other pieces, and to move two spaces farther than standard maximum. This spell may be used for retreating in battle. Three points are added to the number cast by the die for the spell. Two "power gems" are used for this spell.

POWER STRIKE: Opposing piece loses eight "life points" of damage if spell is successful. Three "power gems" required.

In addition, any of the Staff or Ring of Life Magic Items as provided on the Magic Item cards, may be used in battle by the wizard.

Wizard Non-Battle Spells

ANIMATE CHIP: Wizard may "animate" a marker or chip used to designate a defeated piece which is within one space of the wizard piece, and use it as a corresponding allied piece. Other attributes of the "animated" piece (life points and battle bonus) are identical to warrior pieces. Duration of spell is determined by casting the six sided die. Spell may be overcome by victorious opponent in battle with wizard. No further spells may be cast by wizard during such battle. Four power gems must be used for this spell.

POWER STRIKE: May be cast if wizard is within two spaces of subject opposing piece. Piece loses eight life points of damage if spell is successful. Three power gems required.

PIECE POSSESSION: Wizard may control an opposing piece within one space of the wizard. Spell is valid for one to six turns, depending upon outcome of six sided die cast. Six power gems required.

LOCATE RELIC: Any lair within one space of the wizard must be revealed. The specific number and location of the lair is not revealed. Requires four power gems.

Cleric Non-Battle Spells

HEAL: Cleric may add six life points to any piece within one space of the cleric piece.

REGAIN PIECE: Cleric may revitalize any defeated piece except king and wizard. Regained pieces have six life points added.

In addition, any of the Mace, Staff, Shield, or Ring of Life Magic items as provided on the Magic Item cards, may be used in battle by the wizard.

All successful spells, either by a wizard or by a cleric, and whether battle or non-battle, require a roll of at least twenty on the thirty sided die, in order to be considered successful.

All "spells" performed by a wizard require the dispensing of certain number of "power gems." These "gems" cannot be regained, once they have been used. Each wizard begins the game with forty eight "power gems" (sixteen considered to be in the possession of the wizard during play, shown in area 102 of the status board 86, and another thirty two in a "gem chest," as indicated in area 100 of the board). A wizard may only carry a maximum of sixteen "power gems" at any one time (with the exception that a wizard having the "bag of power gems" magic item card of table I may have a total of twenty six "power gems" in possession). The use of these "power gems" is recorded by placing a peg 88 in the area 102 of the status board 86. When a wizard has used all of the "gems" in his possession (i. e., the "wizards PGs" area 102 indicates none remaining), the wizard may return to his starting position on the board 10, whereupon the pegs 88 in the "gem chest" and "wizard's PGs" areas 100/102 of the status board 86 are moved to indicate the transfer of "gems" to the wizard. When a wizard has depleted his supply, he may also "plunder" another wizard's "gem chest" by moving to the opposing wizard's starting position on the board.

In addition to the above "magic spells," other pieces may make use of magic items as provided on the appropriate magic item cards 110 of FIG. 4A, and as listed in table I. The weaponry listed on the "ancient relic" cards 114 of FIG. 4B may also be used, if captured from a defeated guardian in accordance with the rules discussed above. It should be noted, however, that each of the pieces is limited to the use of a specific weapon, or group of weapons, and is not allowed to make use of a weapon not of the same general type as that originally provided at the start of the game, and listed on the status or battle board 86.

As an example, a wizard is limited to the use of a staff, and thus cannot use any of the magical swords, maces, and other magical weapons disclosed on many of the cards. However, where compatible weaponry is obtainable, the various pieces (and players controlling those pieces) may benefit from the additional powers provided by such magical weapons, relics, and other items. This is indicated generally in the optional step 140 of FIG. 7A, showing the steps involved in the method of play of the present game.

Yet another of the provisions of the present game, is for a player to trade hypothetical weaponry, magic items, etc. between allied pieces under the control of that player. In order for a trade to take place, (1) the pieces involved in the trade must be moved to immediately adjacent positions or spaces on the board; and (2) pieces cannot trade weapons (either standard or magical) which are not compatible with the receiving piece. (e. g., while a warrior may use a cleric's mace, the cleric cannot accept a warrior's sword, so no such trade is permitted.) This optional provision is indicated as step 142 of FIG. 7A.

The present disclosure thus far has provided four different means for the various pieces to be equipped with representations of weaponry or items having elevated or magical powers: (1) playing pieces may gain weapons or other items having elevated powers by means of the magic item cards; (2) victorious pieces may appropriate weapons or other items from defeated pieces previously provided with such weapons or items, so long as they are compatible with the limitations of the victorious piece; (3) they may gain such weapons or items by happening upon an opponent's "lair" and defeating the lair's "guardian" to capture the associated "ancient relic"; and (4) allied pieces (i.e., pieces being controlled by any one given player) having weapons or articles with special powers which are compatible with one another, may trade those weapons or articles.

Another means of gaining such a weapon or article is provided by using the rogue playing pieces 64 to attempt to "steal" a magical article or relic from another playing piece, as indicated in the optional step 144 of FIG. 7A. In order to "steal" the weapon or article of another playing piece, the rogue piece 64 must be moved to the same position 38 of 40 on the central area 36 of the board 10, as in initializing a "battle engagement" between pieces. The engaging rogue piece 64 may not have control of more than one such magical article or relic at a time (this is true of all pieces), and thus cannot attempt such a "theft" if the piece is already in control of such an article. Ally "theft" attempt must take place before any battle commences, and the player having the rogue piece must roll a count of at least twenty on the thirty sided die 120, in order for the "theft" to be considered successful. Should the "theft" be successful, the rogue piece 64 may use the "stolen" magical article or weapon against the opposing piece, in a subsequent battle. However, should the "theft" be unsuccessful, three additional points are awarded to the score of the opposing piece for the first round of battle.

The rogue pieces 64 also have another ability beyond that of the other pieces of the present game: When a rogue piece 64 attacks an opposing king playing piece 68, the rogue piece may attempt to "assassinate" the king to win the game, or at least for the king allied to the rogue to gain control of the assassinated king's playing pieces for the remainder of the game (if three or more opponents are still playing). This is also indicated in the optional step 144 of FIG. 7A, generally describing the actions of the rogue playing pieces of the present game.

An "assassination attempt" is essentially identical to the initial round of a battle engagement between pieces, except that the attempt must comprise a rogue piece attacking an opposing king piece; other combinations of pieces, or a king piece attacking a rogue piece, cannot comprise an assassination attempt. The thirty sided die is cast by the player controlling the rogue piece, with the odds for a successful "assassination" depending upon the "strength" or "life level" of the attacking rogue piece, in accordance with the following table:

TABLE VI

| ASSASSINATION | |
|---|---|
| If Rogue Level of Strength Is: | First Cast of Die Must Be At Least: |
| 1 | 29 |
| 2 | 27 |
| 3 | 25 |
| 4 | 23 |
| 5 | 21 |
| 6 | 19 |

The higher the "strength" or "life level" of the attacking rogue piece, the greater the odds for a successful assassination. The assassination attempt must be made on the first roll of the thirty sided die, before any conventional "battle" takes place.

The present game also provides certain counter advantages to the king pieces 68 of each side. The kings have the potential ability to cause an attacking piece (any piece, not only opposing rogues) to become a "turncoat." If the king is successful, the opposing piece is transferred to control of the player of the successful king, to be used otherwise conventionally with the exception that the "turncoat" piece cannot ever again pass beyond the inner area (the fourth, fifth, and sixth individual player rows 48/50/52) within the "castle wall" 70. Thus, any "turncoat" attempt must occur within this area, and cannot occur on the common central area 36 or any individual player area beyond the "wall" 70.

A turncoat attempt begins identically to any battle engagement between opposing pieces, with the king and opposing piece occupying the same position on the board. The process is indicated generally as optional step 146 of FIG. 7A. The "turncoat" attempt must be made by the player of the king before any battle engagement is begun, and the king must be relatively "weak," i. e., may have no more than eleven "life points." Both players cast the thirty sided die 120, with the king receiving a bonus to add to (or subtract from) the number cast, in accordance with the following table:

TABLE VII

| TURNCOAT ATTEMPT | | | | |
|---|---|---|---|---|
| King Skill | Type of Piece Attacking | | | |
| Level | Cleric | Knight | Rogue | All Other Pieces |
| 1 | −2 | −4 | +1 | 0 |
| 2 | −2 | −3 | +1 | 0 |
| 3 | −1 | −2 | +2 | 0 |
| 4 | 0 | −1 | +2 | +1 |
| 5 | +1 | 0 | +3 | +1 |
| 6 | +2 | 0 | +3 | +2 |

(NOTE: The king may have a relatively high skill level, and a relatively low "life point" level, due to reductions in strength due to previous "battles.") If the "turncoat" attempt fails, the opposing piece gains an additional four points to be applied to the "battle bonus" for that piece, on the next "battle round".

As noted above, the present game provides for the revival or reinstatement of any of the playing pieces (excepting any king, wizard, or guardian piece) by an allied cleric piece. However, this reinstatement provision is of course not possible, if both clerics of a given side or set have been defeated and removed from the board, as this power of revival is only granted active cleric pieces in play. Accordingly, the king has the power to "promote" warrior or captain pieces to knighthood to replace a defeated knight, in the absence of any active allied cleric pieces in play.

This promotion procedure requires that the warrior or captain piece have "proven himself" by engaging in at least one "battle" prior to the promotion attempt. A qualified warrior or captain piece is moved to a position or space adjacent to the corresponding king, whereupon the player controlling the "knight candidate" and king, casts the thirty sided die. If the resulting count is ten or more, the candidate piece is promoted to knighthood, and resumes the place of (one of) the defeated knight(s) on the status or battle board 86. As the defeated knight being replaced would by definition have a "life point" count of no more than one (otherwise it would not have been defeated and removed from the board), a six sided die 124 is cast to determine the skill level (and corresponding "life level" and "battle bonus") of the new knight piece, and the portion of the status board 86 of the defeated knight is used to record these statistics for the new knight. The original, defeated knight piece is used physically on the board as the new knight.

The game continues in accordance with all of the above described rules and procedures, with each player ultimately attempting to engage an opposing king in battle, and to defeat that king in battle. (This is generally done with the relatively straightforward battle procedure discussed above, rather than using a wizard piece to attempt to "cast a spell" on the king, as the king is granted relative immunity from spells, by requiring the wizard to score a number on the thirty sided die which is at least eight higher than number cast for the opposing king.) When a king is ultimately defeated (i. e., "life points" for the king reduced to a level of one or fewer), the king is considered to be "defeated" and is no longer in play.

Figure 7B:
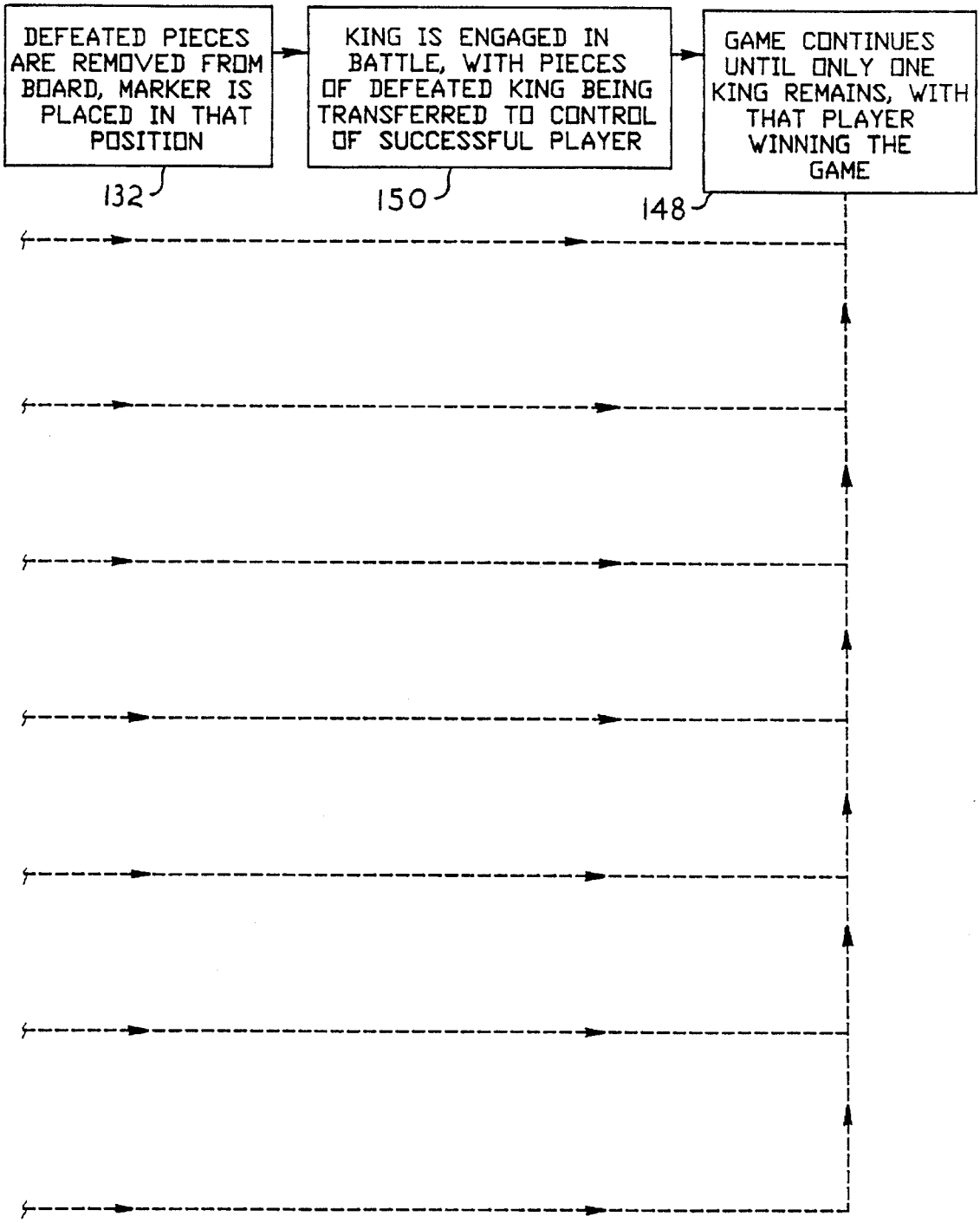
FIG. 7B is the right side of the flow chart of FIG. 7A.

Assuming only two players are playing the present game, obviously the player having the sole remaining active king is the winner of the game, as indicated in step 148 of FIG. 7B. However, where four players are playing, the defeat of one king still leaves three opposing sides in play. Rather than "freezing" the positions of the pieces of the defeated king, or removing them from the board, the present game provides for the control of such pieces to be transferred to the player who had defeated the king. Thus, if player one defeated the king of player three, with players two and four remaining in the game, then player one would have control not only of all remaining player one pieces on the board, but would also control all remaining pieces (if any) which were originally controlled by player three. It will be seen that this could provide a substantial advantage to a player who has defeated the king of at least one other opponent. The above procedure is described generally in step 150 of FIG. 7B, and continues until only one active king remains, with the player of that king being the winner of the game, as indicated in step 148 of FIG. 7B.

The above described board game apparatus and method of play will be seen to provide an absorbing and relatively complex game for two or four players, involving not only numerous elements of chance and different chance means, but also requiring considerable strategy for a player to be consistently successful. The game provides a reasonable simulation of medieval European political and military conflict, and will be seen to provide untold hours of entertainment for persons interested in such intriguing pastimes.

It is to be understood that the present invention is not limited to the sole embodiment described above, but encompasses any and all embodiments within the scope of the following claims.

I claim:

1. A board game apparatus for a plurality of players, comprising:

a substantially square game board having a square central area divided into a matrix of playing positions, said matrix of playing positions oriented diagonally relative to the sides of the square game bard wherein the lines defining the matrix of playing positions intersect the sides of the game board at a diagonal, said central area having a first, second, third, and fourth corner, and a first, second, third, and fourth triangularly shaped individual playing area respectively disposed at said first, second, third, and fourth corner of said board, and a substantially square common playing field diagonally disposed across said central area of said board wherein the lines bounding the square common playing field intersect the sides of the game board at a diagonal, said square common playing field, extending between each said individual playing area, said first, second, third and fourth individual playing areas each having indicia thereon distinguishing the individual playing areas from the square common playing field and;

a first, second, third, and fourth set of playing pieces respectively corresponding to each said first, second, third, and fourth individual playing area, with each said set comprising a plurality of playing pieces and at least some of said playing pieces within each said set having a different movement pattern from others of said playing pieces on said board, whereby;

players alternatingly move said playing pieces from respective said individual playing areas and across said common playing field of said board in accordance with game rules, and attempt to capture and depose said playing pieces of each other said set from said board to win the game.

2. The board game apparatus of claim 1, including:

a first, second, third, and fourth peripheral movement counter extending completely around the edge of said board, with each said movement counter being disposed adjacent a corresponding said individual player area and adapted for registering movement count of a corresponding said set of said playing pieces.

3. The board game apparatus of claim 1, wherein:

said common playing field of said board comprises a plurality of individual playing positions, with a fraction of said plurality of playing positions of said common playing field comprising designated numbered positions affecting play.

4. The board game apparatus of claim 1, wherein:

each said first, second, third, and fourth individual player area is divided into an inner portion and an outer portion, with each said outer portion being disposed between a corresponding said inner portion and said common player area of said board, and;

said inner portion of each said individual player area has starting positions for at least some of a corresponding said set of playing pieces, and a corresponding said outer portion of each said individual playing area has starting positions for remaining said playing pieces of said corresponding said set of playing pieces.

5. The board game apparatus of claim 4, wherein:

each said inner portion and corresponding said outer portion are separated, with limited access being provided therebetween.

6. The board game apparatus of claim 1, wherein:

each said individual player area includes a first array of starting positions for play using two said sets of playing pieces, and a second array of starting positions for play using more than two said sets of playing pieces, and;

each of said sets of playing pieces has a greater number of playing pieces when two said sets of playing pieces are used than when more than two said sets of playing pieces are used.

7. The board game apparatus of claim 1, including:

a game status board for each of the players of the game, said game status board providing at least means for registering the status of each of said playing pieces of a corresponding said set of playing pieces.

8. The board game apparatus of claim 7, wherein:

said game apparatus includes a plurality of cards, and;

each said game status board includes skill and strength level indications for said corresponding said set of playing pieces, and card display means precluding viewing of one face of said cards by opposing players when said cards are placed within said card display means of each said game status board.

9. The board game apparatus of claim 1, including:

at least one weapon damage and spell chart providing for the determination of the status of said playing pieces according to game rules.

10. The board game apparatus of claim 1, including:

a marker chip corresponding to each of said playing pieces and providing position marking for each of said pieces which are removed from said game board during the course of play.

11. The board game apparatus of claim 1, including:

chance means comprising cards having instructions thereon affecting the outcome of the game, and a plurality of dice each comprising a different regular polyhedron having a differing number of faces from one another.

12. A method of playing a board game, comprising the following steps:

(a) providing a game board having a square central area divided into a matrix of playing positions, said matrix of playing positions oriented diagonally relative to the sides of the square game board wherein the lines defining the matrix of playing positions intersect the sides of the game board at a diagonal, said central area having a substantially square common playing field diagonally disposed thereacross wherein the lines bounding the square common playing field intersect the sides of the game board at a diagonal, said square central area also having four individual player areas disposed at the corners of the board each individual player area having respective starting positions, with the common playing field and individual player areas each having a plurality of playing positions thereon;

(b) further providing four sets of playing pieces with each set corresponding to one of the individual playing areas of the game board, and with each set comprising a plurality of playing pieces with at least some of the playing pieces within each set having a different movement pattern from other playing pieces within each set and further each including a king playing piece;

(c) further providing a plurality of cards containing instructions affecting the outcome of play, and a plurality of dice each comprising a regular polyhedron, with each die having a different number of faces;

(d) determining the order of play among the players and placing the playing pieces for each player at their respective starting positions in each of the individual player areas of the board;

(e) alternatingly using at least one of the dice to determine the total number of board positions over which at least one of the playing pieces of a set controlled by the player may move, and moving those pieces a number of positions totaling no more than the total count rolled using the at least one of the dice;

(f) engaging a playing piece of another player in battle by moving a playing piece to the same board position as an opposing playing piece, with each player involved in the battle alternatingly casting at least one of the dice to determine simulated battle damage to the battling playing pieces;

(g) removing any playing pieces defeated in battle;

(h) engaging the king playing piece of another player in battle, with each player involved in the battle alternatingly casting at least one of the dice to determine simulated battle damage to the battling king playing piece and other playing piece;

(i) passing control of the playing pieces associated with any defeated king playing piece, to the player controlling the playing pieces of the playing piece defeating the king, and;

(j) continuing in accordance with the above rules until only one king playing piece remains, with the player controlling the one remaining king playing piece being the winner of the game.

13. The method of playing a board game according to claim 12, including the steps of:

(a) providing at least some of the playing pieces of each set with a first predetermined level of strength;

(b) causing the first predetermined level of strength to be reduced according to the outcome of any simulated battle between such playing pieces, and;

(c) removing from the board any defeated playing piece having a level of strength reduced below a predetermined minimum second level of strength due to simulated battle damage, which minimum second level of strength is less than the first predetermined level of strength.

14. The method of playing a board game according to claim 13, including the steps of:

(a) providing a cleric playing piece for each set, with each cleric playing piece having the property of providing an increase in the level of strength for any defeated playing piece of that set which has been removed from the board, and;

(b) using the cleric playing piece to regain a defeated playing piece by providing an increase in the level of strength for the defeated playing piece of that set and returning that playing piece to the board for further play.

15. The method of playing a board game according to claim 12, including the step of:

randomly providing magic cards to each player, with the magic cards providing simulated magical powers for advantage in battle.

16. The method of playing a board game according to claim 12, including the step of:

providing a fraction of the common playing field positions with predetermined numbered positions affecting play of the game.

17. The method of playing a board game according to claim 12, including the steps of:

(a) providing representations of articles which may be traded between allied pieces controlled by one player;

(b) positioning one allied playing piece adjacent another allied playing piece, and;

(c) trading articles between the one allied playing piece and the adjacent other allied playing piece.

18. The method of playing a board game according to claim 12, including the steps of:

(a) providing a wizard playing piece for each set, with each wizard playing piece having the property of casting a simulated spell affecting the ability of at least one of the playing pieces of opposing sets, and;

(b) using the wizard playing piece to cast a simulated spell on an opposing playing piece engaged in simulated battle, to influence the outcome of the simulated battle.

19. The method of playing a board game according to claim 12, including the steps of:

(a) engaging an opposing piece in simulated battle with a king playing piece;

(b) announcing a turncoat attempt wherein the opposing piece is urged to change sides, and casting at least one die in order to determine if such attempt is successful, and;

(c) changing the side of the opposing piece to that of the king playing piece when such attempt is successful.

20. The method of playing a board game according to claim 12, including the steps of:

(a) providing representations of articles in the possession of at least some of the playing pieces of each set, and;

(b) providing a rogue playing piece for each set, with the rogue playing piece having the properties of stealing articles from playing pieces of opposing sets, and assassinating opposing kings in accordance with further rules of play.

* * * * *